US011339773B2

(12) United States Patent
Sugino et al.

(10) Patent No.: US 11,339,773 B2
(45) Date of Patent: May 24, 2022

(54) VARIABLE DISPLACEMENT COMPRESSOR

(71) Applicant: SANDEN AUTOMOTIVE COMPONENTS CORPORATION, Isesaki (JP)

(72) Inventors: Kenji Sugino, Isesaki (JP); Yukihiko Taguchi, Isesaki (JP)

(73) Assignee: SANDEN AUTOMOTIVE COMPONENTS CORPORATION, Isesaki (JP)

( * ) Notice: Subject to any disclaimer, the term of this patent is extended or adjusted under 35 U.S.C. 154(b) by 356 days.

(21) Appl. No.: 16/630,376

(22) PCT Filed: Jun. 18, 2018

(86) PCT No.: PCT/JP2018/023912
§ 371 (c)(1),
(2) Date: Jan. 10, 2020

(87) PCT Pub. No.: WO2019/012966
PCT Pub. Date: Jan. 17, 2019

(65) Prior Publication Data

US 2020/0132061 A1 Apr. 30, 2020

(30) Foreign Application Priority Data

Jul. 14, 2017 (JP) ..... JP2017-138075

(51) Int. Cl.
*F04B 27/18* (2006.01)
*F04B 27/16* (2006.01)
*F04B 27/10* (2006.01)

(52) U.S. Cl.
CPC ..... *F04B 27/1804* (2013.01); *F04B 27/1009* (2013.01); *F04B 27/16* (2013.01);
(Continued)

(58) Field of Classification Search
CPC .. F04B 27/1009; F04B 27/1018; F04B 27/16; F04B 27/1804; F04B 2027/1813;
(Continued)

(56) References Cited

U.S. PATENT DOCUMENTS 6,953,325 B2 * 10/2005 Weber ..... F04B 27/1081 417/213
8,714,938 B2 * 5/2014 Okuda ..... F04B 27/1804 417/269

(Continued)

FOREIGN PATENT DOCUMENTS

JP 2005-009422 A 1/2005
JP 2016-108960 A 6/2016

OTHER PUBLICATIONS

Japan Patent Office, International Search Report issued in International Application No. PCT/JP2018/023912, dated Sep. 18, 2018.

*Primary Examiner* — Devon C Kramer
*Assistant Examiner* — Joseph S. Herrmann
(74) *Attorney, Agent, or Firm* — Baker Botts L.L.P.

(57) ABSTRACT

A spool operation failure due to foreign matter contamination is prevented. A variable displacement compressor 100 includes a first control valve 300 controlling the opening degree of a supply passage 145, a check valve 350, a second control valve 400 controlling the opening degree of a discharge passage 146, and a back-pressure relief passage 147. The second control valve 400 includes a back pressure chamber 410 communicating with an intermediate supply passage **145*b*1, a valve chamber 420 to which a valve hole 103*d* and a discharge hole 431*a* are open and that constitutes a part of the discharge passage 146, a partition member 430 partitioning into the back pressure chamber 410 and the valve chamber 420, and a spool 440 extending through a through hole 432*a* formed in the partition member 430. The spool 440 has a pressure receiving portion 441** disposed in
(Continued)

the back pressure chamber 410, a valve portion 442 disposed in the valve chamber 420, and a shaft portion 443. The spool 440 is supported in a manner slidable in the opening and closing directions on the partition member 430 by arranging the spool valve 440*a*, constituted by the valve portion 442 and the shaft portion 443, to be in contact with the partition member 430.

11 Claims, 18 Drawing Sheets

(52) U.S. Cl.
CPC ..... *F04B 2027/1813* (2013.01); *F04B 2027/1827* (2013.01); *F04B 2027/1831* (2013.01); *F04B 2027/1859* (2013.01)

(58) Field of Classification Search
CPC ..... F04B 2027/1827; F04B 2027/1831; F04B 2027/1859
See application file for complete search history.

(56) References Cited

U.S. PATENT DOCUMENTS

2004/0258536 A1 12/2004 Ota et al.
2017/0356439 A1 12/2017 Taguchi

* cited by examiner

FIRST STATE

IMMEDIATELY AFTER CLOSING OF FIRST CONTROL VALVE

SECOND STATE

VARIABLE DISPLACEMENT COMPRESSOR

CROSS-REFERENCE TO RELATED APPLICATIONS

This application is a U.S. National Stage Patent Application under 35 U.S.C. § 371 of International Patent Application No. PCT/JP2018/023912, filed on Jun. 18, 2018, which claims the benefit of Japanese Patent Application No. 2017-138075, filed on Jul. 14, 2017, the disclosures of each of which are incorporated herein by reference in their entirety.

TECHNICAL FIELD

The present invention relates to variable displacement compressors capable of changing discharge displacement depending on the pressure in a controlled pressure chamber, such as a crank chamber.

BACKGROUND ART

As an example of this type of a variable displacement compressor, a variable displacement compressor disclosed in Patent Document 1 is known. The variable displacement compressor disclosed in Patent Document 1, includes: a first control valve controlling the opening degree of a supply passage providing communication between a discharge chamber and a crank chamber; a second control valve controlling the opening degree of a discharge passage providing communication between the crank chamber and a suction chamber; and a check valve provided between the first control valve and the crank chamber in the supply passage, and preventing backflow of refrigerant flowing from the crank chamber toward the first control valve, the variable displacement compressor controlling the discharge displacement by adjusting pressure in the crank chamber.

The second control valve includes: a back pressure chamber communicating with a region downstream of the first control valve in the supply passage, through a communication passage; a valve chamber separated from the back pressure chamber by a partition member, the valve chamber constituting a part of the discharge passage, and the valve chamber having a valve hole communicating with the crank chamber formed at a wall surface on the side opposite the back pressure chamber; and a spool. The spool has a pressure receiving portion disposed in the back pressure chamber, a valve portion disposed in the valve chamber, and a shaft portion extending through the partition member and connecting the pressure receiving portion and the valve portion. The second control valve is configured so that, when the first control valve opens and a force moving the spool toward the valve hole generated by the pressure applied to the pressure receiving portion exceeds a force moving the spool away from the valve hole generated by the pressure applied to the valve portion, the valve portion comes into contact with the wall surface of the valve chamber to close the valve hole, resulting in a minimized opening degree of the discharge passage, whereas when the first control valve closes and the force moving the spool toward the valve hole generated by the pressure applied to the pressure receiving portion decreases below the force moving the spool away from the valve hole generated by the pressure applied to the valve portion, the valve portion moves away from the wall surface to open the valve hole, resulting in a maximized opening degree of the discharge passage.

REFERENCE DOCUMENT LIST

Patent Document

Patent Document 1: JP 2016-108960 A

SUMMARY OF THE INVENTION

Problem to be Solved by the Invention

In the conventional variable displacement compressor, when the first control valve opens the supply passage, refrigerant in the region downstream of the first control valve in the supply passage flows through the communication passage and flows into the back pressure chamber of the second control valve, resulting in an increase in pressure in the back pressure chamber. This causes the spool to move in a direction that minimizes the opening degree of the discharge passage (i.e., a direction approaching the valve hole).

Here, there is a concern that minute foreign matter might flow through the supply passage, etc., with the refrigerant in the conventional variable displacement compressor. Thus, there is a possibility that, when the first control valve opens the supply passage, foreign matter might flow into the back pressure chamber through the communication passage together with the refrigerant. Furthermore, in the conventional variable displacement compressor, the spool is slidably supported by arranging the pressure receiving portion of the spool to be in sliding contact with the inner peripheral surface of the back pressure chamber. Thus, there is a concern that when refrigerant flows into the back pressure chamber together with foreign matter, the foreign matter might enter between the outer peripheral surface of the spool and the inner peripheral surface of the back pressure chamber, and might prevent the operation of the spool.

Thus, an object of the present invention is to provide a variable displacement compressor capable of preventing or suppressing an occurrence of operation failure of a spool that might be caused by foreign matter entering into the back pressure chamber in the second control valve controlling the opening degree of the discharge passage.

Means for Solving the Problem

According to an aspect of the present invention, there is provided a variable displacement compressor including a suction chamber to which refrigerant is directed, a compression section configured to draw in the refrigerant in the suction chamber and compress the refrigerant, a discharge chamber into which the refrigerant compressed by the compression section is discharged, and a controlled pressure chamber, the variable displacement compressor changing discharge displacement depending on a pressure in the controlled pressure chamber. The variable displacement compressor includes a first control valve, a check valve, a second control valve, and a throttle passage. The first control valve is provided in a supply passage for supplying the refrigerant in the discharge chamber to the controlled pressure chamber, the first control valve controlling an opening degree of the supply passage. The check valve is provided in a downstream side supply passage extending between the first control valve and the controlled pressure chamber in the supply passage, the check valve preventing backflow of the refrigerant flowing from the controlled pressure chamber toward the first control valve. The second control valve is provided in a discharge passage for discharging the refrigerant in the controlled pressure chamber into the suction chamber, the second control valve controlling an opening degree of the discharge passage. The throttle passage provides communication between an intermediate supply passage extending between the first control valve and the check valve in the downstream side supply passage, and the suction chamber. The throttle passage has a throttle part. The second control valve includes: a back pressure chamber communicating with the intermediate supply passage; a valve chamber; a partition member partitioning into the back pressure chamber and the valve chamber; and a spool. The valve chamber to which a valve hole and a discharge hole are open, the valve hole constituting a second control valve-side end of an upstream side discharge passage extending between the second control valve and the controlled pressure chamber in the discharge passage, the discharge hole communicating with the suction chamber. The valve chamber constituting a part of the discharge passage. The spool includes a pressure receiving portion disposed in the back pressure chamber, a valve portion disposed in the valve chamber and contacting and departing from a valve seat provided around the valve hole, and a shaft portion extending through a through hole formed in the partition member and connecting the pressure receiving portion and the valve portion. The second control valve is configured to move the spool depending on a pressure in the back pressure chamber and a pressure in the upstream side discharge passage so as to have the valve portion contact and depart from the valve seat, thereby controlling the opening degree of the discharge passage. The spool is supported in a manner slidable in opening and closing directions on the partition member by arranging the spool valve, constituted by the valve portion and the shaft portion, to be in sliding contact with the partition member.

Effects of the Invention

According to the variable displacement compressor according to one aspect of the present invention, the spool of the second control valve is supported in a manner slidable in opening and closing directions on the partition member by arranging the spool valve, constituted by the valve portion and the shaft portion, to be in sliding contact with the partition member. Thus, the spool is supported in a manner slidable in the opening and closing direction on the partition member, employing, as a sliding contact portion, a portion of the spool (i.e., a portion of the spool valve including the valve portion and the shaft portion) other than the pressure receiving portion disposed in the back pressure chamber, into which foreign matter might flow. Thus, the support portion of the spool is set to a part of the spool that is other than the pressure receiving portion. Thus, even if foreign matter enters the back pressure chamber together with refrigerant through the intermediate supply passage extending between the first control valve and the check valve in the supply passage when the first control valve opens the supply passage, it is possible to operate the spool satisfactorily. In this manner, it is possible to provide a variable displacement compressor capable of preventing or suppressing the occurrence of spool operation failure due to the inflow of foreign matter into the back pressure chamber.

MODE FOR CARRYING OUT THE INVENTION

Hereinbelow, embodiments of the present invention will be described in detail with reference to the accompanying drawings.

First Embodiment

Figure 1:
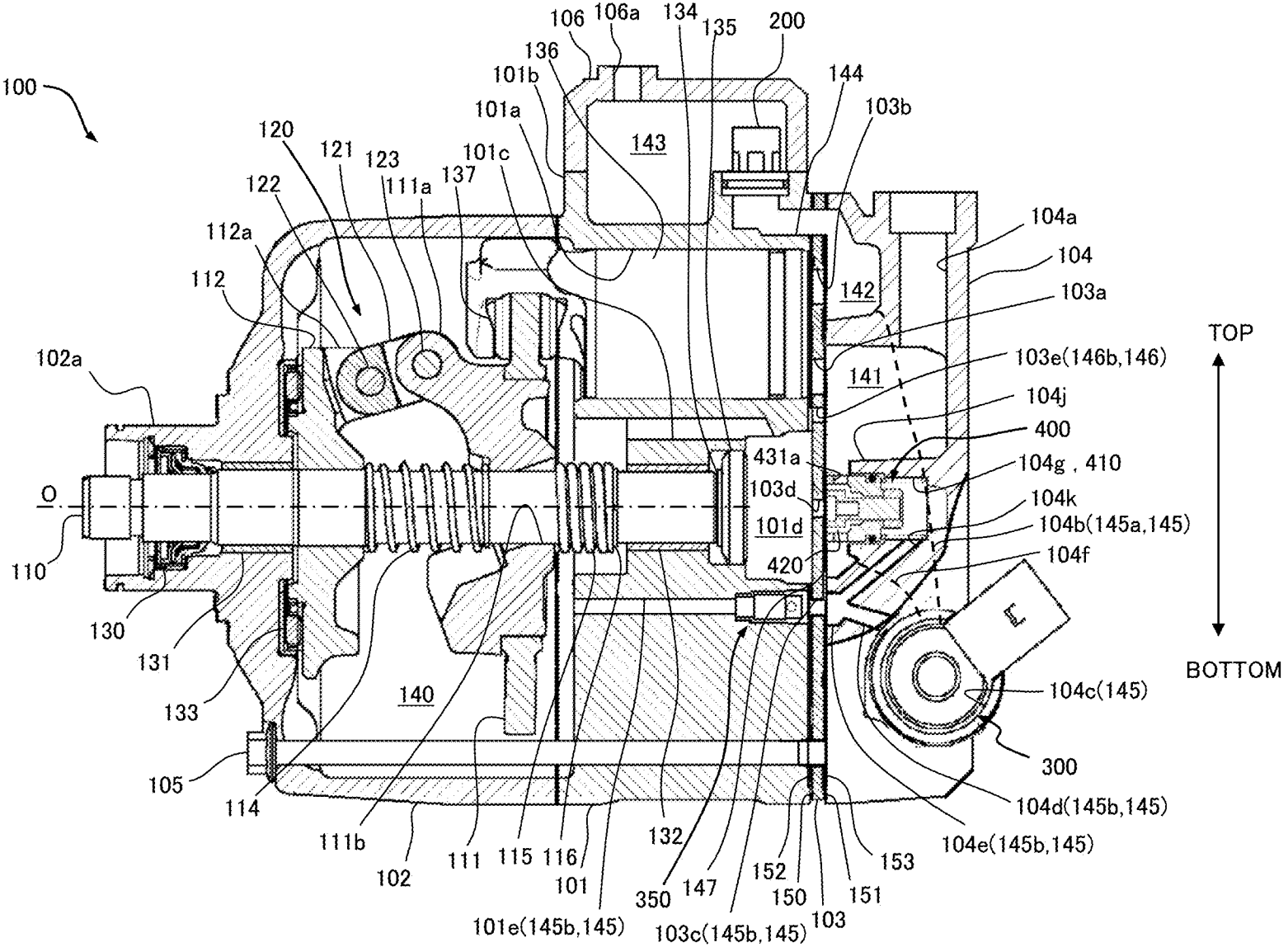
FIG. 1 is a cross-sectional view of a variable displacement compressor according to a first embodiment of the present invention.

FIG. 1 is a cross-sectional view of a variable displacement compressor according to a first embodiment of the present invention, and illustrates a variable displacement clutchless compressor applied to an air conditioning system for a vehicle. FIG. 1 shows a state in which this variable displacement clutchless compressor is mounted on a vehicle (that is, a compressor installed state). In the drawing, the upper side is the upper side in the direction of gravity, and the lower side is the lower side in the direction of gravity.

A variable displacement compressor 100 shown in FIG. 1 is provided with: a cylinder block 101 in which multiple cylinder bores 101*a* are formed; a front housing 102 provided on one end of the cylinder block 101; and a cylinder head 104 provided on the other end of the cylinder block 101 via a valve plate 103. A crank chamber 140, serving as a controlled pressure chamber, is formed by the cylinder block 101 and the front housing 102. A drive shaft 110 is arranged across the crank chamber 140.

A swash plate 111 is disposed around an intermediate portion in the extending direction of the axis O of the drive shaft 110. The swash plate 111 is coupled, via a linkage 120, to a rotor 112 secured to the drive shaft 110, and rotates with the drive shaft 110. The swash plate 111 is configured so that the angle with respect to a plane orthogonal to the axis O (hereinafter referred to as "inclination angle") is changeable. The linkage 120 is provided with: a first arm 112*a* protruding from the rotor 112; a second arm 111*a* protruding from the swash plate 111; and a link arm 121 having one end rotatably connected to the first arm 112*a* via a first connecting pin 122, and the other end rotatably connected to the second arm 111*a* via a second connecting pin 123.

A through hole 111*b* of the swash plate 111, through which the drive shaft 110 is inserted, is formed in such a shape that the swash plate 111 is capable of inclining within a range between a maximum inclination angle and a minimum inclination angle. In the through hole 111*b*, a minimum inclination angle regulating portion that is adapted to contact the drive shaft 110, is formed. In a case in which the inclination angle (the minimum inclination angle) of the swash plate 111 is 0° when the swash plate 111 is orthogonal to the axis O, the minimum inclination angle regulating portion of the through hole 111*b* is formed such that the minimum inclination angle regulating portion contacts the drive shaft 110, when the angle of the swash plate 111 is substantially 0°, to regulate further inclination of the swash plate 111. When the inclination angle of the swash plate 111 reaches the maximum inclination angle, the swash plate 111 contacts the rotor 112 so that further inclining motion is restricted.

On the drive shaft 110, there are fitted an inclination angle decreasing spring 114 that urges the swash plate 111 in a direction in which the inclination angle of the swash plate 111 decreases, and an inclination angle increasing spring 115 that urges the swash plate 111 in a direction in which the inclination angle of the swash plate 111 increases. The inclination angle decreasing spring 114 is disposed between the swash plate 111 and the rotor 112, and the inclination angle increasing spring 115 is fitted between the swash plate 111 and a spring support member 116 secured to the drive shaft 110. Here, when the inclination angle of the swash plate 111 is the minimum inclination angle, the biasing force of the inclination angle increasing spring 115 is set to be greater than that of the inclination angle decreasing spring 114. Accordingly, when the drive shaft 110 is not rotating, the swash plate 111 is positioned at an inclination angle at which the biasing force of the inclination angle decreasing spring 114 and that of the inclination angle increasing spring 115 are balanced.

One end (the left end in FIG. 1) of the drive shaft 110 extends through a boss 102*a* of the front housing 102 to the outside of the front housing 102. A power transmission device (not shown) is connected to the one end of the drive shaft 110. A shaft sealing device 130 is arranged between the drive shaft 110 and the boss 102*a*, and the interior of the crank chamber 140 is isolated from the exterior by the shaft sealing device 130.

A coupled body of the drive shaft 110 and the rotor 112 is supported by bearings 131 and 132 in the radial direction, and is supported by a bearing 133 and a thrust plate 134 in the thrust direction. The drive shaft 110 (and the rotor 112) is configured to be rotated in synchronization with the rotation of the power transmission device by the power from the external drive source transmitted to the power transmission device. A clearance between the other end of the drive shaft 110, that is, the end on a thrust plate 134 side, and the thrust plate 134, is adjusted to a predetermined distance by an adjust screw 135.

In each cylinder bore 101*a*, a piston 136 is disposed. An inner space of a protruding portion of the piston 136 protruding into the crank chamber 140, accommodates an outer peripheral portion of the swash plate 111 and the vicinity thereof via a pair of shoes 137. This causes the swash plate 111 to work together with the piston 136. Thus, the piston 136 reciprocates in the cylinder bore 101*a* as the swash plate 111 rotates in accordance with the rotation of the drive shaft 110. The stroke amount of the piston 136 changes depending on the inclination angle of the swash plate 111.

The front housing 102, a center gasket (not shown), the cylinder block 101, a rubber coated cylinder gasket 152, a suction valve forming plate 150, the valve plate 103, a discharge valve forming plate 151, a rubber coated head gasket 153, and the cylinder head 104 are successively connected to each other, and are fastened by a plurality of through-bolts 105 to form a compressor housing.

At the central portion of the cylinder head 104, there is formed a suction chamber 141, and there is defined a discharge chamber 142 annularly surrounding the outer side in the radial direction of the suction chamber 141. The suction chamber 141 communicates with the cylinder bore 101*a* via a communication hole 103*a* provided in the valve plate 103 and a suction valve (not shown) formed in the suction valve forming plate 150. The discharge chamber 142 communicates with the cylinder bore 101*a* via a communication hole 103*b* provided in the valve plate 103 and a discharge valve (not shown) formed in the discharge valve forming plate 151. In the cylinder head 104, a suction passage 104*a* extends linearly from a radially outside of the cylinder head 104 to cross a part of the discharge chamber 142.

The suction chamber 141 is connected to the suction-side refrigerant circuit of the air conditioner system through the suction passage 104*a*.

In addition, a muffler is provided on the upper portion of the cylinder block 101 in order to reduce noise and vibrations caused by pressure pulsation of refrigerant (refrigerant gas). The muffler is formed by fastening a lid member 106 having a discharge port 106*a* open, and a muffler forming wall 101*b* formed at the top of the cylinder block 101, via a sealing member (not shown). A discharge check valve 200 is arranged in a muffler space 143 surrounded by the lid member 106 and the muffler forming wall 101*b*.

The discharge check valve 200 is disposed at an end of a communication passage 144 on the side of the muffler space 143, the communication passage 144 providing communication between the discharge chamber 142 and the muffler space 143. The discharge check valve 200 operates in response to a pressure difference between the communication passage 144 (upstream side) and the muffler space 143 (downstream side). Specifically, the discharge check valve 200 is configured to block the communication passage 144 when the pressure difference is less than a predetermined value, and open the communication passage 144 when the pressure difference is greater than the predetermined value.

The discharge chamber 142 is connected to the refrigerant circuit (the high pressure side thereof) of the air conditioning system via a discharge passage formed by the communication passage 144, the discharge check valve 200, the muffler space 143, and the discharge port 106*a*. Furthermore, backflow of refrigerant (refrigerant gas) flowing from the high pressure side of the refrigerant circuit of the air conditioning system toward the discharge chamber 142 is blocked by the discharge check valve 200.

The refrigerant on the low pressure side of the refrigerant circuit of the air conditioning system is directed to the suction chamber 141 through the suction passage 104*a*. The refrigerant in the suction chamber 141 is drawn into the cylinder bore 101*a* by the reciprocating motion of the piston 136, and then, is compressed and discharged into the discharge chamber 142. That is, in the present embodiment, the cylinder bore 101*a* and the piston 136 constitute a compression section that takes in and compresses the refrigerant in the suction chamber 141. The refrigerant (refrigerant compressed by the compression section) discharged into the discharge chamber 142 is introduced into the refrigerant circuit on the high-pressure side of the air conditioning system through the discharge passage.

A supply passage 145 is formed in the cylinder head 104. This supply passage 145 is provided with a first control valve 300 and a check valve 350. Formed in the cylinder block 101 and the cylinder head 104 is a discharge passage 146. This discharge passage 146 is provided with a second control valve 400. Between the cylinder block 101 and the cylinder head 104, a back-pressure relief passage 147 is provided.

Supply Passage

Figure 2:
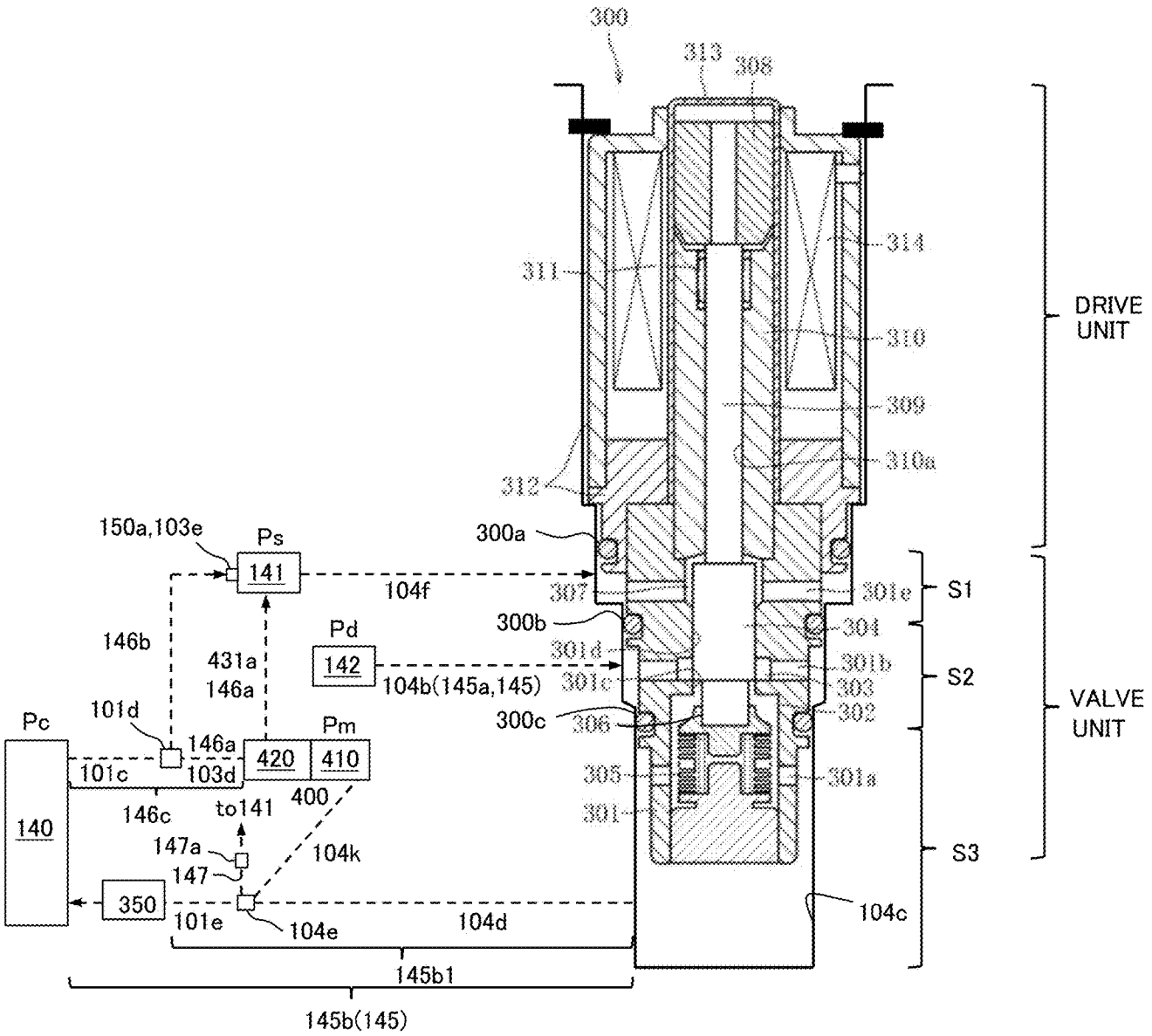
FIG. 2 is a cross-sectional view of a first control valve of the variable displacement compressor, and a conceptual diagram illustrating a system diagram of passages through which refrigerant flows.
Figure 3:
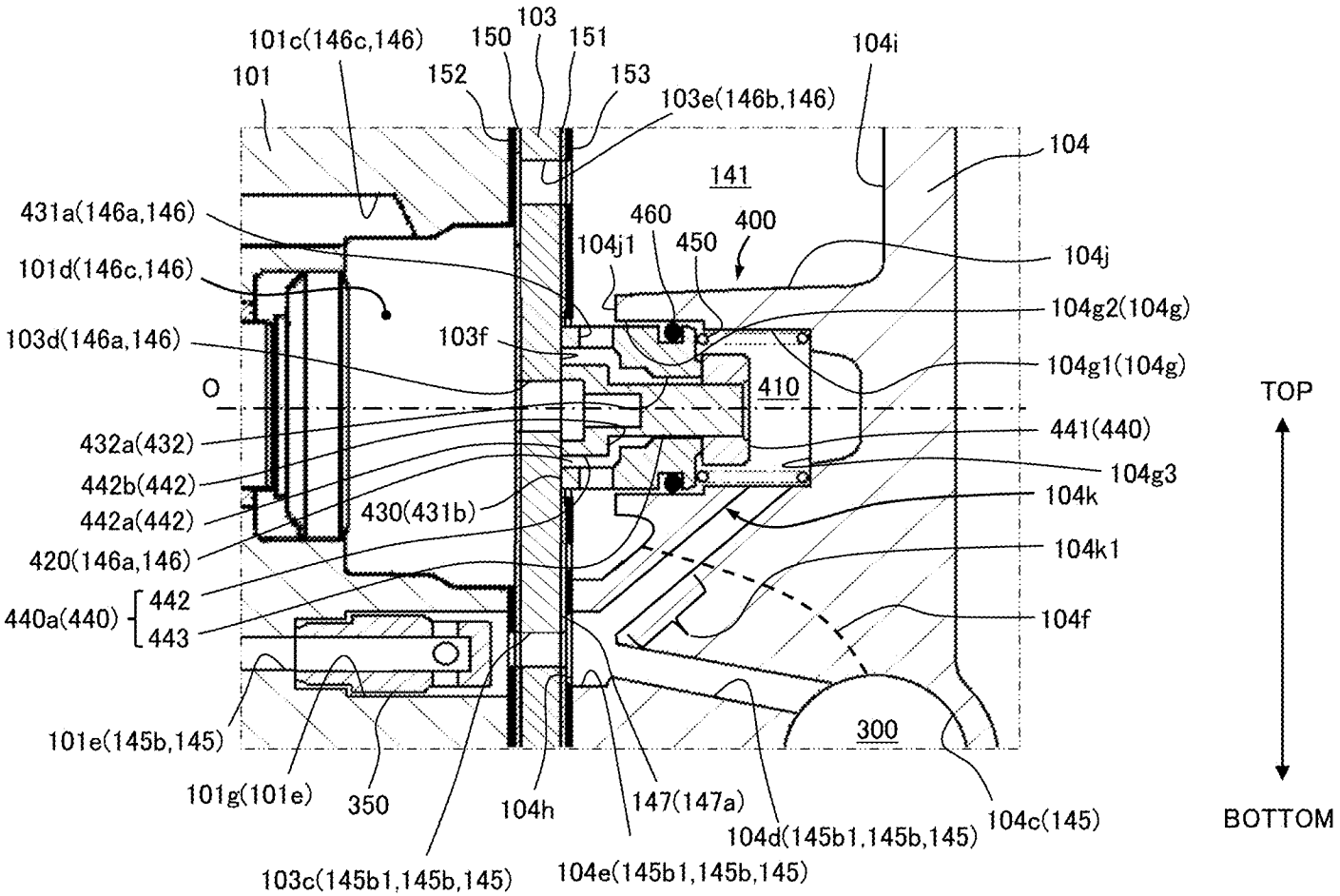
FIG. 3 is an enlarged cross-sectional view illustrating the main part of the variable displacement compressor.

FIG. 2 is a cross-sectional view of the first control valve 300, and is a conceptual diagram illustrating the system diagram of passages through which refrigerant flows. FIG. 3 is a cross-sectional view illustrating the main part of the variable displacement compressor 100 including the check valve 350 and the second control valve 400. The supply passage 145 is a passage for supplying refrigerant in the discharge chamber 142 to the crank chamber 140. Herein, the portion of the supply passage 145 extending between the discharge chamber 142 and the first control valve 300 is referred to as an upstream side supply passage 145*a*, and the portion of the supply passage 145 extending between the first control valve 300 and the crank chamber 140 is referred to as a downstream side supply passage 145*b*. As described below, the supply passage 145 extends via the first control valve 300, and is opened and closed by the first control valve 300. The check valve 350 is provided in the downstream side supply passage 145*b*.

In the present embodiment, the supply passage 145 extends via a communication passage 104*b* formed in the cylinder head 104, a second region S2 (see FIG. 2), described below, of an accommodating hole 104*c* for the first control valve 300 formed in the cylinder head 104, the interior of the first control valve 300 (see FIG. 2), a third region S3 (see FIG. 2), described below, of the accommodating hole 104*c*, a communication passage 104*d* formed in the cylinder head 104, a connection portion 104*e* open in a connection end surface 104*h* of the cylinder head 104, at which the cylinder head 104 connects to the cylinder block 101 (head gasket 153), a communication hole of the head gasket 153, a communication hole of the discharge valve forming plate 151, a communication hole 103*c* formed in the valve plate 103, a communication hole of the suction valve forming plate 150, a valve hole 152*a* formed in a cylinder gasket 152, a communication passage 101*e* extending through the cylinder block 101, and a second passage 351*c*2 and a first passage 351*c*1, described below, of the check valve 350 (see FIGS. 7A and 7B mentioned below), and provides communication between the discharge chamber 142 and the crank chamber 140. Thus, in the present embodiment, the communication passage 104*b* and the second region S2 constitute the upstream side supply passage 145*a*, and the passage including the third region S3 (see FIG. 2), the communication passage 104*d*, the connection portion 104*e*, the communication hole of the head gasket 153, the communication hole of the discharge valve forming plate 151, the communication hole 103*c*, the communication hole of the suction valve forming plate 150, the valve hole 152*a* of the cylinder gasket 152, the communication passage 101*e*, and the second passage 351*c*2 and the first passage 351*c*1 constitutes the downstream side supply passage 145*b*.

Discharge Passage

The discharge passage 146 is a passage for discharging refrigerant in the crank chamber 140 into the suction chamber 141. As shown in FIGS. 1 to 3, in the present embodiment, the discharge passage 146 branches into two passages on the suction chamber 141 side. One passage thereof (a first discharge passage 146*a*, described below) extends via the second control valve 400, and is opened and closed by the second control valve 400. In the present embodiment, the discharge passage 146 has a communication passage 101*c* extending through a front housing 102-side end surface of the cylinder block 101 toward the cylinder head 104, and a space 101*d* to which the communication passage 101*c* is connected and which is open at a cylinder head 104-side end surface of the cylinder block 101.

Figure 4:
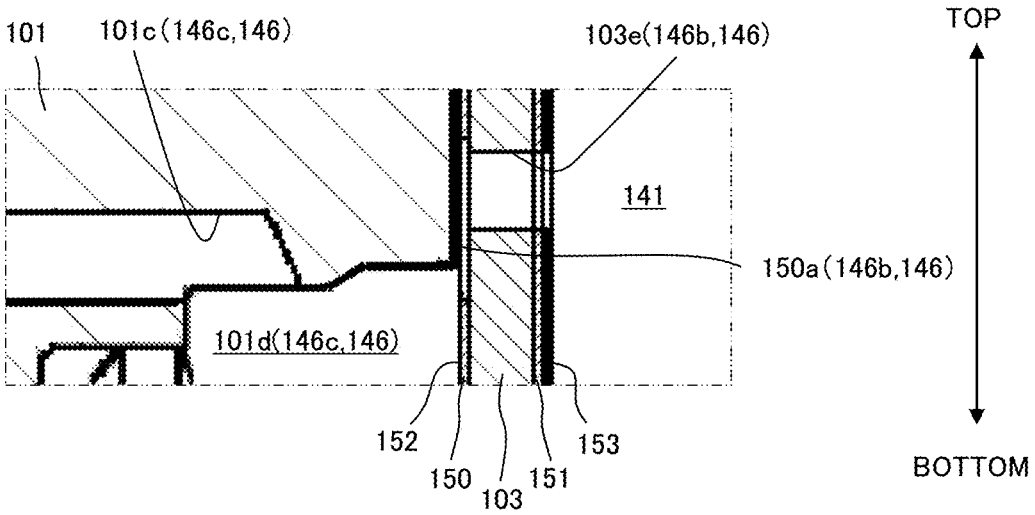
FIG. 4 is an enlarged partial cross-sectional view including a part of a discharge passage of the variable displacement compressor.

FIG. 4 is an enlarged partial view including a part of the discharge passage 146 (a second discharge passage 146*b*, described below). As shown in FIGS. 1 to 3, in the present embodiment, the discharge passage 146 branches, at the space 101*d*, into the first discharge passage 146*a* and the second discharge passage 146*b*. The first discharge passage 146*a* is formed so as to extend from the space 101*d* via a communication hole of the cylinder gasket 152, the communication hole of the suction valve forming plate 150, a valve hole 103*d*, described below, extending through the valve plate 103, a valve chamber 420, described below, of the second control valve 400, and a discharge hole 431*a*, and to open into the suction chamber 141. As shown in FIG. 4, the second discharge passage 146*b* is formed to extend from the space 101*d* via the communication hole formed in the cylinder gasket 152, a groove 150*a*, as a fixed throttle, formed in the suction valve forming plate 150, a communication hole 103*e* formed in the valve plate 103, a communication hole of the discharge valve forming plate 151, and a communication hole of the head gasket 153, and to bypass the second control valve 400, constantly maintaining communication between the space 101*d* and the suction chamber 141. A passage extending between the second control valve 400 and the crank chamber 140 in the discharge passage 146 is referred to as an upstream side discharge passage 146*c* (see FIG. 2). The flow passage sectional area of the first discharge passage 146*a* when opened by the second control valve 400 is set to be greater than the flow passage sectional area of the groove 150*a*, which serves as the fixed throttle of the second discharge passage 146*b*.

Back-Pressure Relief Passage (Throttle Passage)

As shown in FIGS. 2 and 3, the back-pressure relief passage 147 provides communication between an intermediate supply passage 145*b*1 extending between the first control valve 300 and the check valve 350 in the downstream side supply passage 145*b*, and the suction chamber 141, and is a passage serving as a throttle passage having a throttle part 147*a*.

Figure 5:
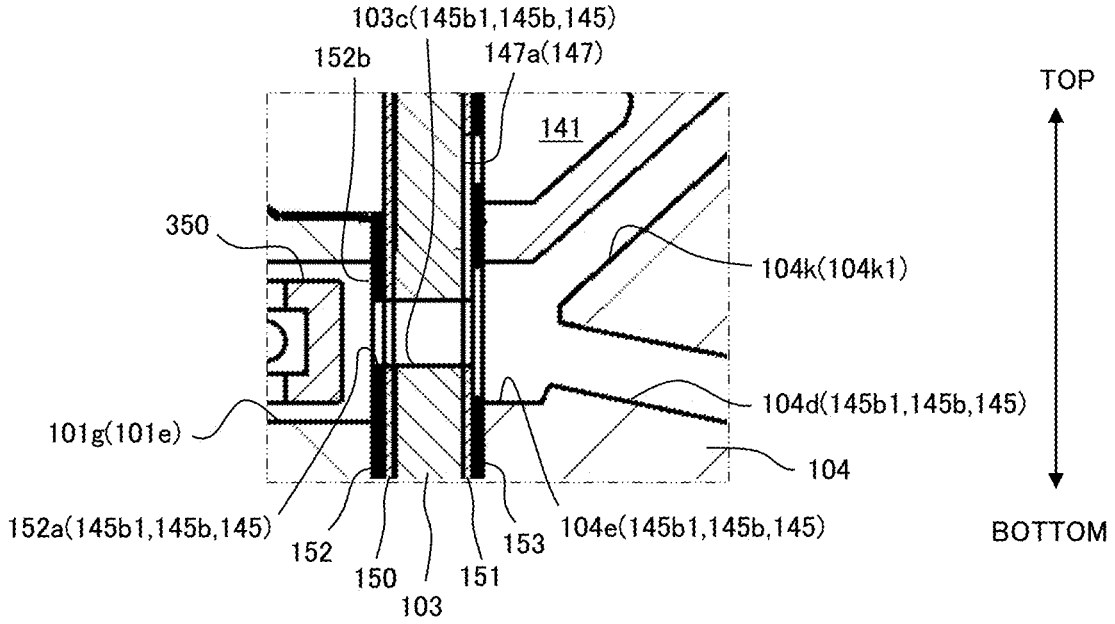
FIG. 5 is an enlarged partial cross-sectional view including a back-pressure relief passage of the variable displacement compressor.

FIG. 5 is an enlarged partial view including the back-pressure relief passage 147.

In the present embodiment, the throttle part 147*a* is constituted by a groove formed so as to extend through the discharge valve forming plate 151. This groove is open to the connection portion 104*e* and is open to the communication hole of the head gasket 153. In the present embodiment, the back-pressure relief passage 147 extends via the throttle part 147*a* formed in the discharge valve forming plate 151 and the communication hole of the head gasket 153, constantly maintaining communication between the connection portion 104*e* (that is, the intermediate supply passage 145*b*1) and the suction chamber 141.

The intermediate supply passage 145*b*1 (see FIG. 2) of the downstream side supply passage 145*b* is formed by the third region S3 (see FIG. 2), the communication passage 104*d*, the connection portion 104*e*, the communication hole of the head gasket 153, the communication hole of the discharge valve forming plate 151, the communication hole 103*c*, the communication hole of the suction valve forming plate 150, the valve hole 152*a* of the cylinder gasket 152, and a passage extending between the connection portion 104*e* and the check valve 350 in the communication passage 101*e*.

When the first control valve 300 closes, refrigerant in the intermediate supply passage 145*b*1 flows out into the suction chamber 141 via the back-pressure relief passage 147. This decreases the pressure in the intermediate supply passage 145*b*1 and the pressure in a back pressure chamber 410, described below, of the second control valve 400. This causes the check valve 350 and a spool 440 of the second control valve 400 to move, as described below.

Outline of First Control Valve

The first control valve 300 is configured to adjust (control) the opening area (opening degree) of the supply passage 145, to control the amount of refrigerant supplied from the discharge chamber 142 to the crank chamber 140. Specifically, as shown in FIGS. 1 and 2, the first control valve 300 is accommodated in the accommodating hole 104*c* formed in the cylinder head 104. In the present embodiment, O-rings 300*a* to 300*c* are attached to the first control valve 300. These O-rings 300*a* to 300*c* define, inside the accommodating hole 104*c*, a first region 51 that communicates with the suction chamber 141 through a communication passage 104*f*, a second region S2 that communicates with the discharge chamber 142 through the communication passage 104*b*, and a third region S3 that communicates with the crank chamber 140 through the communication passage 104*d*, the connection portion 104*e*, the communication passage 101*e*, and the check valve 350. The second region S2 and the third region S3 of the accommodating hole 104*c* constitute a part of the supply passage 145. The first control valve 300 controls (adjusts) the opening degree of the supply passage 145 in response to the pressure in the suction chamber 141 directed through the communication passage 104*f* and an electromagnetic force generated by an electric current flowing through a solenoid in response to an external signal, to control the amount of refrigerant supplied to the crank chamber 140.

Outline of Check Valve

The check valve 350 is provided in the downstream side supply passage 145*b* of the supply passage 145 (in other words, in the supply passage 145 downstream of the first control valve 300). The check valve 350 is a valve that is operable to prevent backflow of refrigerant flowing from the crank chamber 140 toward the first control valve 300 and to allow flow of refrigerant from the first control valve 300 toward the crank chamber 140. Specifically, the check valve 350 is formed at the valve plate 103-side opening end portion of the communication passage 101*e* of the cylinder block 101, and is accommodated in an accommodating hole 101*g* constituting a part of a communication passage 101*e*.

Outline of Second Control Valve

The second control valve 400 is provided in the discharge passage 146 (the first discharge passage 146*a* in the present embodiment), and is configured to control the opening degree of the discharge passage 146, to control the amount of refrigerant discharged from the crank chamber 140 to the suction chamber 141. Specifically, the second control valve 400 is accommodated in the accommodating hole 104*g* formed in the cylinder head 104 and open to the suction chamber 141, and the second control valve 400 includes the spool 440 for opening and closing the first discharge passage 146*a* of the discharge passage 146. The second control valve 400 moves the spool 440 depending on the pressure in the intermediate supply passage 145*b*1 extending between the first control valve 300 and the check valve 350 in the downstream side supply passage 145*b* (specifically, the pressure in the back pressure chamber 410, described below) and the pressure in the crank chamber 140 (specifically, the pressure in the upstream side discharge passage 146*c*), to thereby control (adjust) the opening degree of the discharge passage 146, so as to control the amount of refrigerant discharged from the crank chamber 140 to the suction chamber 141.

When the first control valve 300 and the check valve 350 close the supply passage 145, the second control valve 400 opens the first discharge passage 146*a*. In this case, the discharge passage 146 is constituted by the first discharge passage 146*a* and the second discharge passage 146*b*. This causes refrigerant in the crank chamber 140 to quickly flow into the suction chamber 141, and the pressure in the crank chamber 140 becomes equal to the pressure in the suction chamber 141, resulting in a maximum inclination angle of the swash plate. This maximizes the piston stroke (discharge displacement).

When the first control valve 300 and the check valve 350 open the supply passage 145, the second control valve 400 closes the first discharge passage 146*a*. In this case, the discharge passage 146 is constituted solely by the second discharge passage 146*b*. This restricts flow of refrigerant from the crank chamber 140 to the suction chamber 141, and facilitates an increase in pressure in the crank chamber 140. Due to the increase in the pressure in the crank chamber 140, the inclination angle of the swash plate 111 is reduced from the maximum. This reduces the piston stroke (discharge displacement).

Thus, the variable displacement compressor 100 is a compressor having the suction chamber 141, the compression section, the discharge chamber 142, and the crank chamber 140, serving as the controlled pressure chamber, and having discharge displacement that changes depending on the pressure in the crank chamber 140. In other words, the variable displacement compressor 100 is a compressor having discharge displacement controlled by adjusting pressure in the crank chamber 140.

Next, the first control valve 300, the check valve 350, and the second control valve 400 will be described in detail.

First Control Valve

Referring back to FIG. 2, the first control valve 300 is constituted by a valve unit and a drive unit (solenoid) opening and closing the valve unit, and is accommodated in the accommodating hole 104*c* formed in the cylinder head 104.

The valve unit of the first control valve 300 has a cylindrical valve housing 301. Inside the valve housing 301, there are formed a first pressure sensing chamber 302, a valve chamber 303, and a second pressure sensing chamber 307, in this order, in the axial direction.

The first pressure sensing chamber 302 communicates with the crank chamber 140 through a communication hole 301*a* formed in the outer peripheral surface of the valve housing 301, the third region S3 of the accommodating hole 104*c*, and the communication passage 104*d* formed in the cylinder head 104.

The second pressure sensing chamber 307 communicates with the suction chamber 141 through a communication hole 301*e* formed in the outer peripheral surface of the valve housing 301, the first region S1 of the accommodating hole 104*c*, and the communication passage 104*f* formed in the cylinder head 104. The valve chamber 303 communicates with the discharge chamber 142 through a communication hole 301*b* formed in the outer peripheral surface of the valve housing 301, the second region S2 of the accommodating hole 104*c*, and the communication passage 104*b* formed in the cylinder head 104. The first pressure sensing chamber 302 and the valve chamber 303 are formed to be capable of communicating with each other through a valve hole 301*c*.

Between the valve chamber 303 and the second pressure sensing chamber 307, there is formed a support hole 301*d*. A bellows 305 is disposed in the first pressure sensing chamber 302. The bellows 305 is evacuated to create a vacuum thereinside, and contains a spring. The bellows 305 is arranged to be displaceable in the axial direction of the valve housing 301. The bellows 305 has a function as a pressure sensing means for receiving the pressure in the first pressure sensing chamber 302, that is, the pressure in the crank chamber 140.

In the valve chamber 303, a cylindrical valve body 304 is accommodated. The valve body 304 has an outer peripheral surface in close contact with the inner peripheral surface of the support hole 301*d* and the valve body 304 is slidable in the support hole 301*d*. The valve body 304 is movable in the axial direction of the valve housing 301. One end of the valve body 304 is configured to open and close the valve hole 301*c*, and the other end of the valve body 304 projects into the second pressure sensing chamber 307. To the one end of the valve body 304, one end of a rod-like connection portion 306 is secured. The connection portion 306 has the other end arranged in a manner capable of contacting the bellows 305, and has a function of transmitting a displacement of the bellows 305 to the valve body 304.

The drive unit of the first control valve 300 has a cylindrical solenoid housing 312, and the solenoid housing 312 is coaxially coupled to the end portion of the valve housing 301. In the solenoid housing 312, a molded coil 314 having an electromagnetic coil covered with resin is accommodated. Furthermore, in the solenoid housing 312, there is accommodated a cylindrical fixed core 310 coaxially with the molded coil 314, and the fixed core 310 extends from the valve housing 301 to the vicinity of the center of the molded coil 314. The end portion of the fixed core 310 on the side opposite the valve housing 301 is surrounded by a tubular sleeve 313. The fixed core 310 has at its center an insertion hole 310*a*. One end of the insertion hole 310*a* is open to the second pressure sensing chamber 307. Between the fixed core 310 and the closed end of the sleeve 313, there is accommodated a cylindrical movable core 308.

A solenoid rod 309 is inserted into the insertion hole 310*a*, and one end of the solenoid rod 309 is fixed to the proximal end side of the valve body 304 by press-fitting. The other end portion of the solenoid rod 309 is forced into a through hole formed in the movable core 308, and the solenoid rod 309 and the movable core 308 are integrated with each other. Provided between the fixed core 310 and the movable core 308 is a release spring 311 urging the movable core 308 away from the fixed core 310 (in the valve opening direction).

The movable core 308, the fixed core 310, and the solenoid housing 312 are formed of a magnetic material, and constitute a magnetic circuit. The sleeve 313 is formed of a non-magnetic material, such as a stainless-steel material. The molded coil 314 is connected to a control device provided outside the variable displacement compressor 100 via a signal line. When a control electric current I is supplied from the control device, the molded coil 314 generates an electromagnetic force F(i). The electromagnetic force F(i) of the molded coil 314 attracts the movable core 308 toward the fixed core 310, and drives the valve body 304 in the valve closing direction.

Apart from the electromagnetic force F(i) generated by the molded coil 314, a biasing force fs generated by the release spring 311, a force generated by the pressure in the valve chamber 303 (discharge chamber pressure Pd), a force generated by the pressure in the first pressure sensing chamber 302 (crank chamber pressure Pc), a force generated by the pressure in the second pressure sensing chamber 307 (suction chamber pressure Ps), and a biasing force F generated by a built-in spring of the bellows 305, act on the valve body 304 of the first control valve 300. Here, the effective pressure receiving area Sb in the expanding and contracting direction of the bellows 305 is Sb, the pressure receiving area of the crank chamber acting on the valve body 304 from the valve hole 301*c* side is Sv, and the cross-sectional area of the cylindrical outer peripheral surface of the valve body 304 is Sr, and a relationship thereamong is established as Sb=Sv=Sr. Accordingly, the relationship between the forces acting on the valve body 304 is expressed by Formula 1. In Formula 1, "+" indicates the valve closing direction of the valve body 304, and "−" indicates the valve opening direction thereof.

$$Ps = -\frac{1}{Sb} \cdot F(i) + \frac{F + f}{Sb} \qquad \text{Formula 1}$$

When the suction chamber pressure Ps becomes greater than a set pressure, the coupled body of the bellows 305, the connection portion 306, and the valve body 304 reduces the opening degree of the supply passage 145 to thereby reduce the crank chamber pressure Pc in order to increase the discharge displacement, and when the suction chamber pressure Ps becomes less than the set pressure, the coupled body increases the opening degree of the supply passage 145 to thereby increase the crank chamber pressure Pc in order to reduce the discharge displacement. That is, the first control valve 300 autonomously controls the opening degree (opening area) of the supply passage 145 so that the suction chamber pressure Ps approaches the set pressure.

Figure 6:
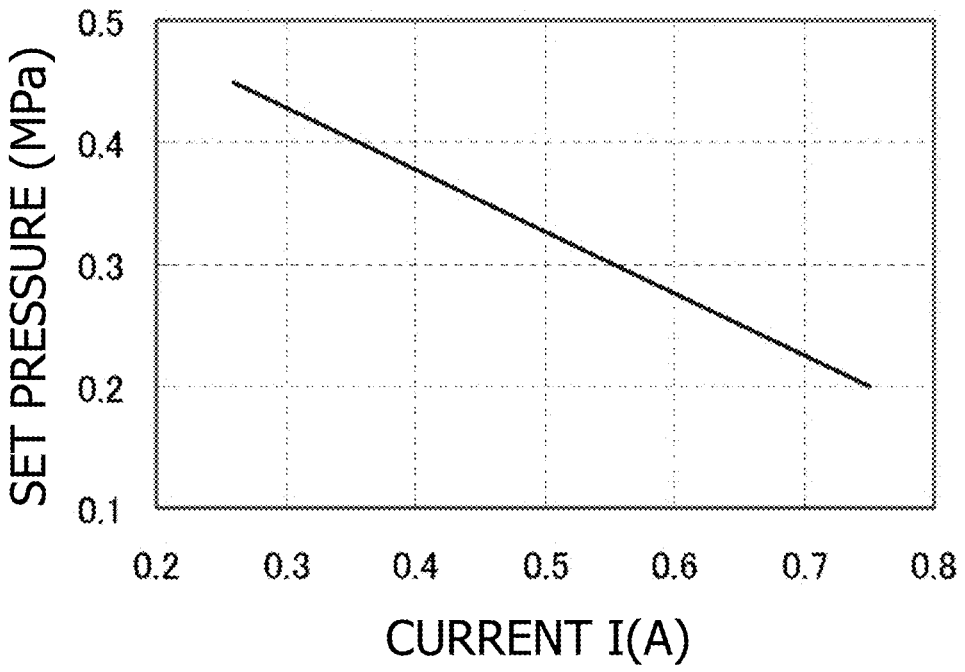
FIG. 6 is a graph showing the relationship between the coil power supply amount of the first control valve and the set pressure.

FIG. 6 is a graph showing the relationship between the coil power supply amount of the first control valve 300 and the set pressure. The electromagnetic force of the molded coil 314 acts on the valve body 304 in the valve closing direction via the solenoid rod 309, so that when the power supply amount to the molded coil 314 increases, the force in the direction in which the opening degree of the supply passage 145 is reduced increases, and the set pressure is changed in the reducing direction as shown in FIG. 6. The control device (drive unit) controls the electricity supply to the molded coil 314 through pulse width modulation (PWM control) at a predetermined frequency in the range, for example, of 400 Hz to 500 Hz, and changes the pulse width (duty ratio) so that the value of the electric current flowing through the molded coil 314 reaches a desired value.

During the operation of the air conditioning system, that is, in the operating state of the variable displacement compressor 100, the power supply amount to the molded coil 314 is adjusted by the control device based on the air conditioning setting, such as the set temperature and the external environment, and the discharge displacement is controlled so that the suction chamber pressure Ps attains a set pressure corresponding to the power supply amount. When the air conditioning system is not operating, that is, in the non-operating state of the variable displacement compressor 100, the control device turns OFF the electricity supply to the molded coil 314. This causes the supply passage 145 to be opened by the release spring 311, and the discharge displacement of the variable displacement compressor 100 is controlled to a minimum.

Check Valve

Figure 7A:
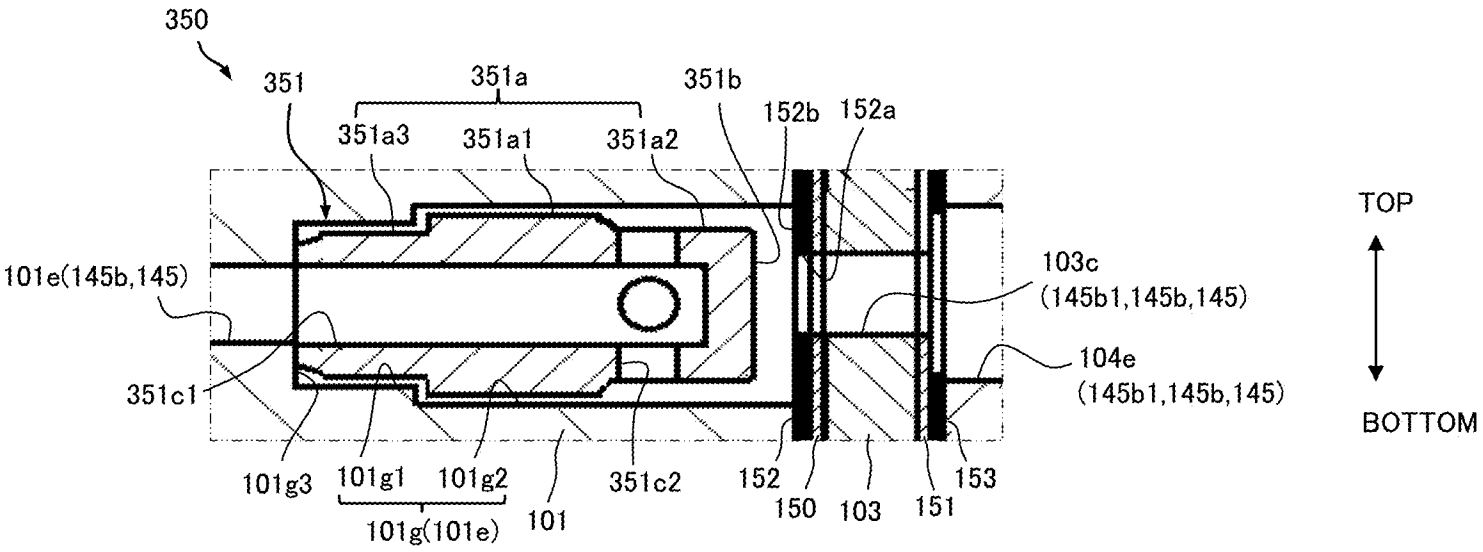
FIGS. 7A and 7B are enlarged partial cross-sectional views each including a check valve of the variable displacement compressor.
Figure 7B:
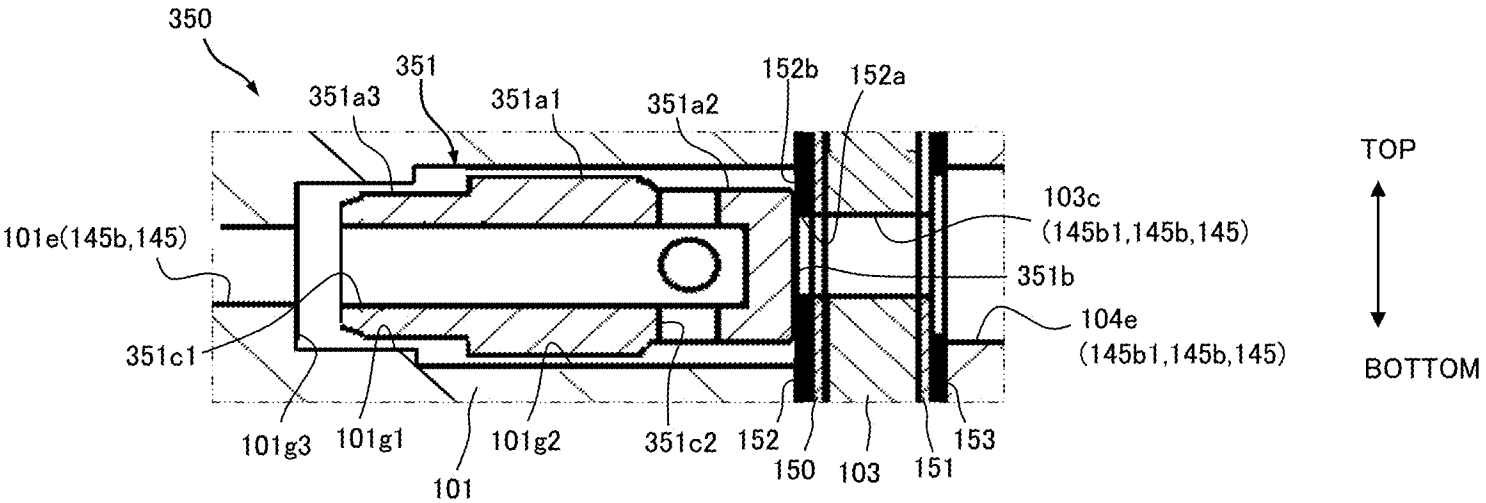

Next, the check valve 350 will be described with reference to FIGS. 7A and 7B. FIGS. 7A and 7B are enlarged partial cross-sectional views of the variable displacement compressor 100 including the check valve 350. FIG. 7A illustrates a state in which the check valve 350 operates so as to allow flow of refrigerant from the first control valve 300 toward the crank chamber 140, and FIG. 7B illustrates a state in which the check valve 350 operates so as to prevent backflow of refrigerant from the crank chamber 140 toward the first control valve 300.

The check valve 350 is provided with a valve body 351, the accommodating hole 101*g* accommodating the valve body 351, and a cylinder gasket 152 that closes one end (right end in FIG. 7) of the accommodating hole 101*g* and serves as a valve seat forming member having the valve hole 152*a* and a valve seat 152*b*. That is, the valve hole 152*a* and the valve seat 152*b* are formed in the cylinder gasket 152.

The valve body 351 has a substantially cylindrical peripheral wall 351*a* and an end wall 351*b* connected to one end of the peripheral wall 351*a*. The peripheral wall 351*a* includes: a large diameter portion 351*a*1 constituting the intermediate portion in the longitudinal direction of the valve body; a first small diameter portion 351*a*2 connecting the large diameter portion 351*a*1 and the end wall 351*b* and having a diameter less than that of the large diameter portion 351*a*1; and a second small diameter portion 351*a*3 extending from the end surface of the large diameter portion 351*a*1 on the side opposite the first small diameter portion 351*a*2 and having a diameter less than that of the large diameter portion 351*a*1. In the valve body 351, an internal passage constituting a part of the supply passage 145 is formed. This inner passage is constituted by a first passage 351*c*1 formed from the open end of the peripheral wall 351*a* to the end wall 351*b*, and a second passage 351*c*2 extending through the peripheral wall of the first small diameter portion 351*a*2 and providing communication between the first passage 351*c*1 and a region in the accommodating hole 101*g* around the first small diameter portion 351*a*2. Although the valve body 351 is formed, for example, of a resin material, it may also be formed of some other material, such as a metal material.

The accommodating hole 101*g* is formed at the valve plate 103-side opening end portion of the communication passage 101*e* of the cylinder block 101, and constitutes a part of the communication passage 101*e* (in other words, the supply passage 145). The accommodating hole 101*g* is constituted by a small diameter portion 101*g*1 on the crank chamber 140 side and a large diameter portion 101*g*2 on the valve plate 103 side, which has a diameter greater than the small diameter portion 101*g*1.

The accommodating hole 101*g* is formed so as to be orthogonal to the end surface of the cylinder block 101, and the valve body 351 moves in the extending direction of the axis O of the drive shaft 110. When the end wall 351*b* of the valve body 351 contacts the valve seat 152*b*, movement in one direction of the valve body 351 is regulated, whereas when the other end of the peripheral wall 351*a* contacts the end surface 101*g*3 of the accommodating hole 101*g*, movement in the other direction of the valve body 351 is regulated. When the end wall 351*b* contacts the valve seat 152*b*, the valve hole 152*a* is closed, and when the end wall 351*b* moves away from the valve seat 152*b*, the valve hole 152*a* is opened.

The accommodating hole 101*g* communicates with the third region S3 of the accommodating hole 104*c* of the first control valve 300 through the intermediate supply passage 145*b*1 extending between the first control valve 300 and the check valve 350 in the downstream side supply passage 145*b*. The communication passage 101*e* extends through the end surface on the front housing 102 side of the cylinder block 101 to extend to the cylinder head 104 side, and, at the same time, extends through the end surface 101*g*3 of the accommodating hole 101*g* to be open in the cylinder head 104-side end surface via the accommodating hole 101*g*.

Thus, the pressure Pm of the intermediate supply passage 145*b*1 (the pressure on the upstream side of the check valve 350) acts on one end of the valve body 351, and the pressure Pc of the crank chamber (the pressure on the downstream side of the check valve 350) acts on the other end of the valve body 351, with the valve body 351 moving in the axial direction depending on the pressure difference between the upstream and downstream sides (Pm−Pc) acting on the valve body 351.

The intermediate supply passage 145*b*1 communicates with the suction chamber 141 through a back-pressure relief passage 147, and this back-pressure relief passage 147 is provided with a throttle part 147*a*. Thus, in a state in which the first control valve 300 opens the valve hole 301*c*, the major portion of refrigerant of the discharge chamber 142 reaches the valve hole 152*a* of the check valve 350 via the communication passage 104*d*, the connection portion 104*e*, the communication hole of the head gasket 153, the communication hole of the discharge valve forming plate 151, the communication hole 103*c*, and the communication hole of the suction valve forming plate 150. This causes the pressure Pm in the intermediate supply passage 145*b*1 acting on one end of the valve body 351 to increase, so that Pm−Pc>0. The pressure difference (Pm−Pc) between the upstream and downstream sides acting on the valve body 351, causes the end wall 351*b* of the valve body 351 to move away from the valve seat 152*b*, and causes the other end of the peripheral wall 351*a* to contact the end surface 101*g*3 of the accommodating hole 101*g*. This causes refrigerant in the discharge chamber 142 to be supplied to the crank chamber 140 from the valve hole 152*a* through the large diameter portion 101*g*2 of the accommodating hole 101*g*, the second passage 351*c*2, the first passage 351*c*1, and the communication passage 101*e* on the downstream side of the check valve 350.

When the first control valve 300 closes the valve hole 301*c*, refrigerant in the discharge chamber 142 is not supplied to the intermediate supply passage 145*b*1, and refrigerant in the intermediate supply passage 145*b*1 flows into the suction chamber 141 through the back-pressure relief passage 147. This causes the pressure Pm of the intermediate supply passage 145b1 acting on one end of the valve body 351 to decrease, so that Pm−Pc<0. Then, due to the pressure difference (Pm−Pc) between the upstream and downstream sides acting on the valve body 351, the other end of the peripheral wall 351a moves away from the end surface 101g3 of the accommodating hole 101g, and the end wall 351b of the valve body 351 contacts the valve seat 152b, so that the check valve 350 cuts off the communication between the downstream communication passage 101e and the intermediate supply passage 145b1. This causes the pressure Pm of the intermediate supply passage 145b1 to be equal to the suction chamber pressure Ps. In this manner, the check valve 350 opens and closes the supply passage 145 in conjunction with the opening and closing of the first control valve 300.

A biasing means, such as a helical compression spring, urging the valve body 351 toward the valve seat 152b may be added to the check valve 350. Furthermore, the valve seat forming member of the check valve 350 is not limited to the cylinder gasket 152. For example, the suction valve forming plate 150 or the valve plate 103 may serve as the valve seat forming member.

Second Control Valve

Figure 8:
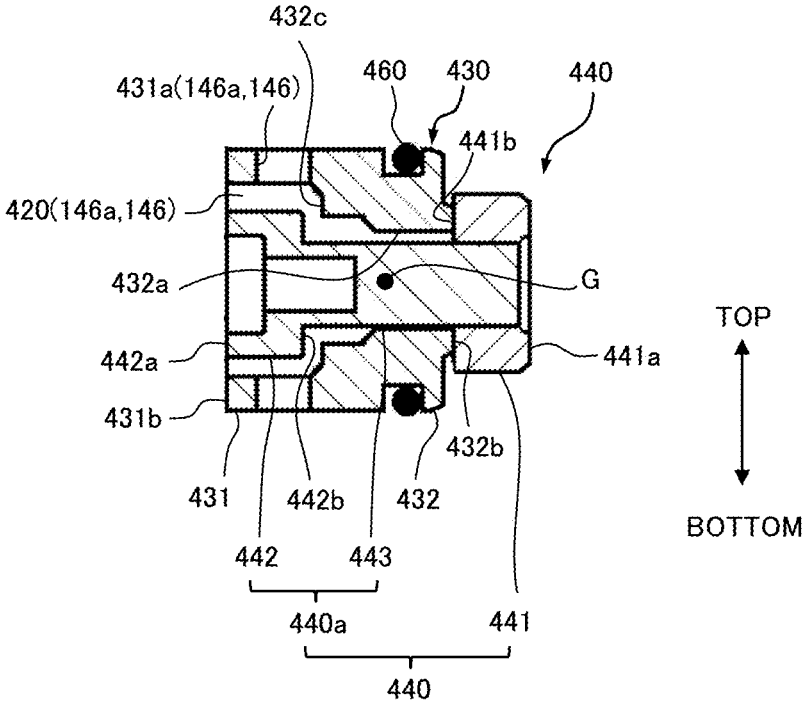
FIG. 8 is a cross-sectional view of a second control valve of the variable displacement compressor.
Figure 9:
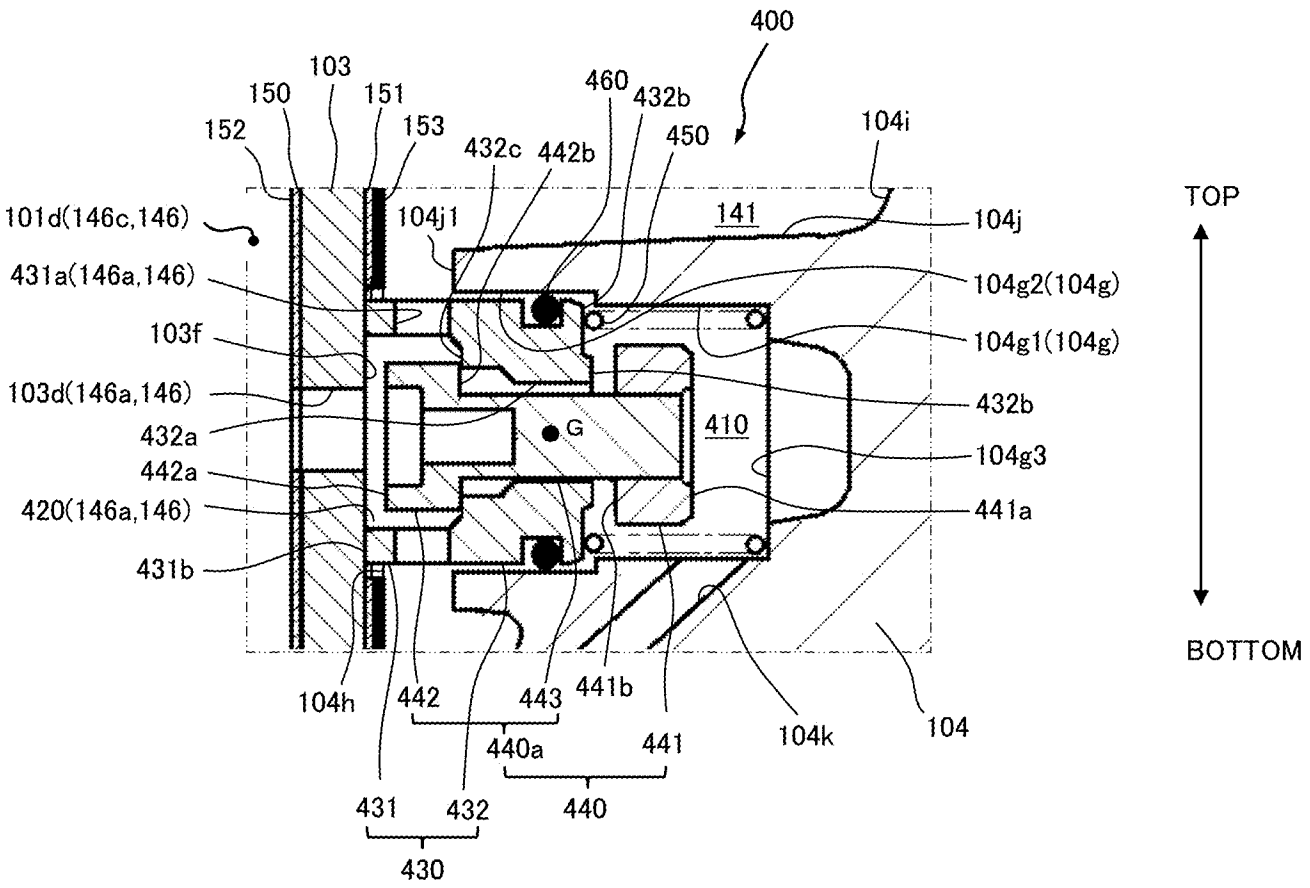
FIG. 9 is a cross-sectional view illustrating a state in which a valve seat-side end surface of the valve portion of the second control valve is spaced away from the valve seat to a maximum.

The second control valve 400 will be described with reference to FIGS. 1 to 3, FIG. 8, and FIG. 9. FIG. 8 is a cross-sectional view of the second control valve 400, and FIG. 9 is a cross-sectional view illustrating a state in which a valve seat-side end surface 442a of a valve portion 442, described below, of the second control valve 400 is spaced away from a valve seat 103f, described below, to a maximum.

The second control valve 400 has the back pressure chamber 410, the valve chamber 420, a partition member 430, and the spool 440. In the present embodiment, the second control valve 400 is accommodated in the accommodating hole 104g, which is formed in the cylinder head 104 and is open to the suction chamber 141.

As shown in FIG. 3, the accommodating hole 104g is formed so as to be open on the connection end surface 104h side connected to the cylinder block 101 (head gasket 153) of the cylinder head 104. Specifically, the accommodating hole 104g is formed in a stepped columnar configuration in a protrusion 104j protruding toward the valve plate 103 from a closed end wall 104i of the suction chamber forming wall of the cylinder head 104. Specifically, the protrusion 104j is arranged in the extension of the axis O of the drive shaft 110, and is situated at the central portion in the radial direction of the suction chamber 141. The protrusion 104j extends from the closed end wall 104i of the cylinder head 104 to a position in front of the connection end surface 104h so as to form a clearance between the protrusion 104j and the head gasket 153. The accommodating hole 104g has the center axis thereof substantially matched with the axis O of the drive shaft 110, and has a large diameter portion on the connection end surface 104h side of the cylinder head 104, a small diameter portion having a diameter less than the large diameter portion on the far side, and a step portion between the large diameter portion and the small diameter portion. The small diameter portion constitutes a first accommodation chamber 104g1, and the large diameter portion constitutes a second accommodation chamber 104g2 accommodating the partition member 430.

The back pressure chamber 410 communicates with the intermediate supply passage 145b1. Specifically, the back pressure chamber 410 communicates with the intermediate supply passage 145b1 through a communication passage 104k connected to the back pressure chamber 410 and the intermediate supply passage 145b1. Thus, the pressure in the back pressure chamber 410 is equal to the pressure Pm in the intermediate supply passage 145b1. In the present embodiment, the back pressure chamber 410 is constituted by the first accommodation chamber 104g1 defined by the partition member 430. The communication passage 104k will be described in detail below.

For example, when the first control valve 300 opens the supply passage 145, refrigerant flows into the back pressure chamber 410 through the communication passage 104k. The back pressure chamber 410 has a relatively large capacity. That is, the back pressure chamber 410 provides an extension (expansion) space between the communication passage 104k and a passage constituted by a clearance between the outer peripheral surface of a shaft portion 443 and the hole wall surface of a through hole 432a of the partition member 430. Thus, the flow rate of the refrigerant flowing into the back pressure chamber 410 from the communication passage 104k decreases in the back pressure chamber 410. Thus, if minute foreign matter flows in together with the refrigerant through the communication passage 104k, the foreign matter might tend to accumulate in the back pressure chamber 410 of the second control valve 400, in particular, in a lower portion of the back pressure chamber 410 in the direction of gravity.

To the valve chamber 420, the valve hole 103d, which is a second control valve-side end of the upstream side discharge passage 146c (see FIG. 2 and FIG. 3) of the discharge passage 146 extending between the second control valve 400 and the crank chamber 140, and the discharge hole 431a communicating with the suction chamber 141, are open. The valve chamber 420 constitutes a part of the discharge passage 146 (specifically, the first discharge passage 146a). In the present embodiment, the discharge hole 431a is formed in a peripheral wall 431, described below, of the partition member 430, and the valve hole 103d is formed in the valve plate 103.

The partition member 430 is a member that partitions into the back pressure chamber 410 and the valve chamber 420. In the present embodiment, the partition member 430 has a cylindrical peripheral wall 431 and a disk-shaped end wall 432. The peripheral wall 431 is formed such that it extends from the end wall 432 toward the valve plate 103 (in other words, toward the valve seat 103f, described below), and contacts the valve plate 103 (in other words, the wall surface on which the valve seat 103f is formed), to surround the valve portion 442, described below, of the spool 440. The discharge hole 431a is formed in the peripheral wall 431. The end wall 432 is formed with the through hole 432a through which a shaft portion 443, described below, of the spool 440 passes. The end wall 432 partitions the accommodating hole 104g into a region on the first accommodation chamber 104g1 side and a region on the second accommodation chamber 104g2 side. The region on the first accommodation chamber 104g1 side of the accommodating hole 104g defined by the end wall 432 constitutes the back pressure chamber 410. The region on the second accommodation chamber 104g2 side (specifically, a cylindrical space inside the peripheral wall 431) of the accommodating hole 104g defined by the end wall 432 constitutes the valve chamber 420.

Specifically, the outer diameter of the peripheral wall 431 of the partition member 430 is set to be less than the inner diameter of the inner wall of the second accommodation chamber 104g2, and a part of the peripheral wall 431 is accommodated in the second accommodation chamber 104g2 with the end surface 431b opposite to the end wall 432 of the peripheral wall 431 contacting the valve plate 103. Thereby, the peripheral wall 431 positions the end wall 432. Furthermore, in order to prevent the refrigerant flowing in from the first accommodation chamber 104g1 from flowing out into the suction chamber 141 through a clearance between the outer peripheral surface of the end wall 432 and the inner wall of the second accommodation chamber 104g2, an O-ring 460 is provided between the outer peripheral surface of the end wall 432 and the inner wall of the second accommodation chamber 104g2.

In the present embodiment, a biasing member 450 for urging the partition member 430 toward the valve plate 103 (the valve seat 103f, described below) is further provided between the outer peripheral surface of a pressure receiving portion 441, described below, of the spool 440, and the inner wall surface of the back pressure chamber 410. Specifically, the biasing member 450 is constituted by a helical compression spring. One end portion of the biasing member 450 constituted by the helical compression spring contacts the radially outer edge portion of a bottom wall 104g3 of the first accommodation chamber 104g1, and the other end portion of the biasing member 450 contacts the radially outer edge of a pressure receiving portion-side end surface 432b of the end wall 432 of the partition member 430.

The partition member 430 is set in position within the second accommodation chamber 104g2 so that by being urged toward the valve plate 103 by the biasing member 450 in a state in which the partition member 430 is accommodated in the second accommodation chamber 104g2, the end surface 431b on the side opposite the end wall 432 of the peripheral wall 431 contacts the valve plate 103 (wall face on which the valve seat 103f, described below, is formed) constituting the wall surface on the side opposite the back pressure chamber 410 of the valve chamber 420. In this state, in the partition member 430, the end surface 431b on the side opposite the end wall 432 of the peripheral wall 431 protrudes further toward the valve plate 103 than the protrusion end surface 104j1 of the protrusion 104j.

Discharge holes 431a open to the valve chamber 420 extend through the peripheral wall 431 at a plurality of positions at intervals in the peripheral direction of the peripheral wall 431. Via the discharge holes 431a, the valve chamber 420 communicates with the suction chamber 141. Specifically, the portion of the peripheral wall 431 on the end surface 431b side protrudes from the protrusion end surface 104j1 of the protrusion 104j toward the valve plate 103 so that the discharge holes 431a directly open to the suction chamber 141. The discharge holes 431a are not limited to holes. They may also be formed as cutouts.

The valve hole 103d, which is open to the valve chamber 420, is formed in the valve plate 103 closing the open end of the partition member 430. The portion of the valve plate 103 around the valve hole 103d constitutes the valve seat 103f. The valve portion 442, described below, of the spool 440 contacts and departs from the valve seat 103f. The valve chamber 420 communicates with the crank chamber 140 through the valve hole 103d, the communication hole of the suction valve forming plate 150, the communication hole of the cylinder gasket 152, the space 101d, and the communication passage 101c. That is, in the present embodiment, the upstream side discharge passage 146c of the discharge passage 146 is constituted by the valve hole 103d, the communication hole of the suction valve forming plate 150, the communication hole of the cylinder gasket 152, the space 101d, and the communication passage 101c.

The spool 440 has the pressure receiving portion 441, the valve portion 442, and the shaft portion 443. The spool 440 has a circular cross section, and is formed to extend in one direction. Each of the pressure receiving portion 441, the valve portion 442, and the shaft portion 443 has a circular cross section.

The pressure receiving portion 441 is arranged inside the back pressure chamber 410 (first accommodation chamber 104g1), and is a member receiving the back pressure Pm. Specifically, as shown in FIGS. 3 and 9, the outer diameter of the pressure receiving portion 441 is determined so that the biasing member 450, constituted by a helical compression spring, can be installed in a cylindrical space defined between the outer peripheral surface of the pressure receiving portion 441 and the inner wall surface of the back pressure chamber 410. In the compressor installed state, a clearance between the outer peripheral surface of the pressure receiving portion 441 and the inner wall surface of the back pressure chamber 410 is determined to be greater than the clearance between the outer peripheral surface of the shaft portion 443 and the hole wall surface of the through hole 432a of the partition member 430. The pressure receiving portion 441 has a pressure receiving end surface 441a facing the bottom wall 104g3 (see FIGS. 3 and 9) of the first accommodation chamber 104g1, and a partition member-side end surface 441b facing the partition member 430 (the pressure receiving portion-side end surface 432b).

The valve portion 442 is arranged inside the valve chamber 420, and is a member contacting and departing from the valve seat 103f around the valve hole 103d. As shown in FIGS. 8 and 9, the valve portion 442 has a valve seat-side end surface 442a facing the valve seat 103f, and an end wall-side end surface 442b facing the end wall 432 of the partition member 430. The valve portion 442 is accommodated in the valve chamber 420, and the valve seat-side end surface 442a contacts and departs from the valve seat 103f to open and close the valve hole 103d.

The shaft portion 443 is a member connecting the pressure receiving portion 441 and the valve portion 442, and is formed so as to extend through a through hole 432a (see FIGS. 8 and 9) formed in the end wall 432 of the partition member 430. The shaft portion 443 has an outer diameter less than the outer diameters of the pressure receiving portion 441 and the valve portion 442. The clearance between the outer peripheral surface of the shaft portion 443 and the hole wall surface of the through hole 432a may be preferably determined to be about 0.2 mm to 0.5 mm, for example. Furthermore, a passage formed by the clearance between the outer peripheral surface of the shaft portion 443 and the hole wall surface of the through hole 432a may provide communication between the back pressure chamber 410 and the valve chamber 420. In addition to this passage formed by the clearance between the outer peripheral surface of the shaft portion 443 and the hole wall surface of the through hole 432a, a groove constituting a passage connecting between the back pressure chamber 410 and the valve chamber 420 may be formed on the outer peripheral surface of the shaft portion 443 or the hole wall surface of the through hole 432a.

Specifically, the shaft portion 443 is formed integrally with the valve portion 442. In a state in which the shaft portion 443 is inserted in the through hole 432a of the partition member 430, the pressure receiving portion 441 is forced into the shaft portion 443, whereby the spool 440 is formed. This portion constituted by the shaft portion 443 and the valve portion 442 is referred to as "spool valve 440a" of the spool 440.

In the present embodiment, the spool 440 has a circular cross section, and is arranged so as to extend in one direction crossing the direction of gravity (vertical direction) in the compressor installed state. Specifically, the spool 440 is arranged so as to extend in one direction orthogonal to the direction of gravity in the compressor installed state. In the compressor installed state, the spool 440 is configured so that the lower part in the direction of gravity of the outer peripheral surface of the shaft portion 443 of the spool valve 440*a* is arranged to be in sliding contact with the lower part in the direction of gravity of the hole wall surface of the through hole 432*a* of the partition member 430.

In this manner, the spool 440 is supported in a manner slidable in opening and closing directions on the partition member 430 by arranging the spool valve 440*a*, constituted by the valve portion 442 and the shaft portion 443, to be in sliding contact with the partition member 430.

In the present embodiment, the spool 440 is arranged so that the position G of the center of gravity of the spool (spool center-of-gravity position G) in the one direction (spool longitudinal direction) crossing the direction of gravity is located in the through hole 432*a* of the partition member 430. Specifically, the spool 440 is configured so that the spool center-of-gravity position G is located in the through hole 432*a* in either opening or closing state.

In the present embodiment, in a state in which the first control valve 300 closes the supply passage 145 and in which the valve seat-side end surface 442*a* of the valve portion 442 is spaced away from the valve seat 103*f* to a maximum, the end wall-side end surface 442*b* contacts the end wall 432, as shown in FIG. 9. Specifically, the length of the pressure receiving portion 441 is determined so that when the spool 440 moves away from the valve seat 103*f*, the end wall-side end surface 442*b* of the valve portion 442 contacts the valve portion-side end surface 432*c* of the end wall 432 before the pressure receiving end surface 441*a* of the pressure receiving portion 441 contacts the bottom wall 104*g*3 of the first accommodation chamber 104*g*1.

In the present embodiment, when the first control valve 300 opens the supply passage 145 and the valve portion 442 contacts the valve seat 103*f*, the pressure receiving portion 441 contacts the end wall 432 of the partition member 430, as shown in FIGS. 3 and 8. Specifically, the forcing-in position in the axial direction of the pressure receiving portion 441 with respect to the spool valve 440*a* is adjusted so that when the valve seat-side end surface 442*a* of the valve portion 442 contacts the valve seat 103*f*, the partition member-side end surface 441*b* of the pressure receiving portion 441 facing the partition member 430 simultaneously contacts the pressure receiving portion-side end surface 432*b* of the end wall 432 facing the pressure receiving portion 441.

Next, the operation of the spool 440 of the second control valve 400 will be described.

The second control valve 400 is formed so that it moves the spool 440 depending on the pressure in the back pressure chamber 410 (hereinafter, referred to as the back pressure) and the pressure in the upstream side discharge passage 146*c* (that is, the crank chamber pressure Pc) to have the valve portion 442 contact and depart from the valve seat 103*f*, thereby controlling the opening degree of the discharge passage 146. As stated above, the back pressure chamber 410 communicates with the intermediate supply passage 145*b*1 through the communication passage 104*k*, so that the pressure in the back pressure chamber 410 (back pressure) is equal to the pressure Pm in the intermediate supply passage 145*b*1. Furthermore, the pressure in the upstream side discharge passage 146*c* is equal to the crank chamber pressure Pc. Thus, the second control valve 400 operates the spool 440 depending on the back pressure (the pressure in the intermediate supply passage 145*b*1) Pm and the crank chamber pressure Pc.

One end surface of the spool 440 (the pressure receiving end surface 441*a* of the pressure receiving portion 441) receives the back pressure Pm, and the other end surface of the spool 440 (the valve seat-side end surface 442*a* of the valve portion 442) receives the crank chamber pressure Pc, so that the spool 440 moves in the axial direction depending on the pressure difference (Pm−Pc). When Pm−Pc>0, the other end surface of the spool 440 comes into contact with the valve seat 103*f*, and the second control valve 400 closes the first discharge passage 146*a*. When Pm−Pc<0, the valve portion 442 comes into contact with the end wall 432 of the partition member 430, and the second control valve 400 opens the first discharge passage 146*a* to a maximum. The pressure receiving area A1 of the spool 440 in the axial direction receiving the back pressure Pm and the pressure receiving area A2 of the spool 440 receiving the crank chamber pressure Pc are set to be, for example, A1=A2. To adjust the operation of the spool 440, however, they may be set to be A1>A2 or A1<A2.

Specifically, in the second control valve 400, when the force in the valve closing direction moving the spool 440 toward the valve seat 103*f* mainly due to the pressure (back pressure Pm) acting on the pressure receiving portion 441 becomes larger than the force in the valve opening direction moving the spool 440 away from the valve seat 103*f* due to the pressure acting on the valve portion 442, the valve portion 442 contacts the valve seat 103*f*, thereby cutting off the communication between the valve hole 103*d* and the discharge hole 431*a* to minimize the opening degree of the discharge passage 146, and when the force in the valve closing direction becomes less than the force in the valve opening direction, the valve portion 442 moves away from the valve seat 103*f*, thereby providing communication between the valve hole 103*d* and the discharge hole 431*a* to maximize the opening degree of the discharge passage 146.

Here, there is a minute clearance between the outer peripheral surface of the shaft portion 443 and the hole wall surface of the through hole 432*a* to allow the spool 440 to move therein (in FIG. 9, etc., this clearance is illustrated to be greater than actual for convenience of explanation). Thus, in the state in which the first control valve 300 closes the supply passage 145 and in which the valve seat-side end surface 442*a* of the valve portion 442 begins to slightly depart from the valve seat 103*f*, a portion of refrigerant having flowed into the valve chamber 420 from the crank chamber 140 via the valve hole 103*d* is able to flow into the back pressure chamber 410 via a clearance between the end wall-side end surface 442*b* of the valve portion 442 and the end wall 432 (specifically, the valve portion-side end surface 432*c*, and via the clearance between the outer peripheral surface of the shaft portion 443 and the hole wall surface of the through hole 432*a*. On the other hand, in a state in which the first control valve 300 closes the supply passage 145 and in which the valve seat-side end surface 442*a* of the valve portion 442 is spaced away from the valve seat 103*f* to a maximum, the end wall-side end surface 442*b* of the valve portion 442 is configured to contact the end wall 432 (specifically, the valve portion-side end surface 432*c*), as shown in FIG. 9, so that the flow of refrigerant from the valve chamber 420 to the back pressure chamber 410 via the clearance between the outer peripheral surface of the shaft portion 443 and the hole wall surface of the through hole 432*a* is cut off. Thus, the end wall-side end surface 442*b* of the valve portion 442 and the valve portion-side end surface 432*c* of the end wall 432 constitute a valve means.

Furthermore, in a state in which the first control valve 300 opens the supply passage 145 and in which the end wall-side end surface 442*b* of the valve portion 442 begins to slightly depart from the valve portion-side end surface 432*c* of the end wall 432, refrigerant having flowed into the back pressure chamber 410 from the communication passage 104*k* flows to the valve chamber 420 through a cylindrical space formed between the outer peripheral surface of the pressure receiving portion 441 and the inner wall surface of the back pressure chamber 410 and the clearance between the outer peripheral surface of the shaft portion 443 and the hole wall surface of the through hole 432*a*. On the other hand, when the first control valve 300 opens the supply passage 145, and the valve seat-side end surface 442*a* of the valve portion 442 contacts the valve seat 103*f*, the partition member-side end surface 441*b* of the pressure receiving portion 441 contacts the pressure receiving portion-side end surface 432*b* of the end wall 432, so that the refrigerant flow from the back pressure chamber 410 to the valve chamber 420 via the clearance between the outer peripheral surface of the shaft portion 443 and the hole wall surface of the through hole 432*a* is cut off. Thus, the partition member-side end surface 441*b* of the pressure receiving portion 441 and the pressure receiving portion-side end surface 432*b* of the end wall 432 constitute a valve means.

Immediately after the first control valve 300 opens the supply passage 145, the back pressure chamber 410 communicates with the valve chamber 420 through the clearance between the outer peripheral surface of the shaft portion 443 and the hole wall surface of the through hole 432*a*. Even if foreign matter flows into the back pressure chamber 410 in this state, the flow rate of refrigerant in the back pressure chamber 410 decreases and this communication state is instantly canceled, and accordingly, the foreign matter is prevented or suppressed from flowing into the clearance between the outer peripheral surface of the shaft portion 443 and the hole wall surface of the through hole 432*a*.

Furthermore, in the state in which the valve portion 442 is in contact with the valve seat 103*f*, the refrigerant in the intermediate supply passage 145*b*1 flows slightly into the suction chamber 141 through the back pressure relief passage 147. As shown in FIG. 5, in the present embodiment, the back-pressure relief passage 147 is open to the suction chamber 141 via the throttle part 147*a* formed in the discharge valve forming plate 151 and the communication hole of the head gasket 153. Specifically, the back-pressure relief passage 147 is formed so as to provide communication between the connection portion 104*e* of the intermediate supply passage 145*b*1 and the suction chamber 141 through a passage formed in the interposed objects (discharge valve forming plate 151 and the head gasket 153) between the cylinder block 101 and the cylinder head 104. In this manner, in the present embodiment, the back-pressure relief passage 147 is formed so as to bypass the second control valve 400 and to provide direct communication between the connection portion 104*e* of the intermediate supply passage 145*b*1 and the suction chamber 141.

Communication Passage

Next, the communication passage 104*k* providing communication between the back pressure chamber 410 and the intermediate supply passage 145*b*1 will be described in detail.

In the present embodiment, one end of the communication passage 104*k* is connected to the connection portion 104*e* provided in the middle of the intermediate supply passage 145*b*1, and the other end of the communication passage 104*k* is connected to the back pressure chamber 410. Of the communication passage 104*k*, at least a communication passage-side connection portion 104*k*1 (See FIG. 3) extending from the connection portion 104*e* toward the back pressure chamber 410 extends at an acute angle with respect to the communication passage 104*d* as the intermediate supply passage-side connection portion extending from the connection portion 104*e* toward the first control valve 300 in the intermediate supply passage 145*b*1. That is, the communication passage 104*k* as the intermediate supply passage-side connection portion branches off from the connection portion 104*e* of the intermediate supply passage 145*b*1 so as to turn back opposite the mainstream direction of the refrigerant flowing through the intermediate supply passage 145*b*1 from the first control valve 300 toward the check valve 350. The communication passage-side connection portion 104*k*1 is a passage portion in the vicinity of the connection portion 104*e* of the communication passage 104*k*.

In the present embodiment, the communication passage 104*k* extends over the entire length of the communication passage at an acute angle with respect to the communication passage 104*d*, serving as the intermediate supply passage-side connection portion. That is, the communication passage 104*k* extends, over the entire length of the communication passage, in one direction opposite the mainstream direction of the refrigerant flowing through the intermediate supply passage 145*b*1 from the first control valve 300 toward the check valve 350. Thus, the communication passage 104*k* and the communication passage 104*d* extending linearly in one direction form a V-shaped passage.

In the present embodiment, the communication passage 104*k* is formed so that the back pressure chamber-side opening end thereof opens in the lower side portion in the direction of gravity of the inner wall surface of the back pressure chamber 410 in the compressor installed state.

In the present embodiment, the connection portion 104*e* of the intermediate supply passage 145*b*1 is arranged so as to be situated on the lower side in the direction of gravity of the second control valve 400 in the compressor installed state. The connection portion 104*e* is arranged at a position closer to the valve plate 103 with respect to the back pressure chamber 410. Thus, the communication passage 104*k* is made to turn at the connection portion 104*e* and extends obliquely upwards to open to the back pressure chamber 410.

Operation of Variable Displacement Compressor

Here, the operation of the variable displacement compressor 100 will be described.

When, in a state in which the variable displacement compressor 100 is being operated, the electricity supply to the molded coil 314 of the first control valve 300 is cut off, the first control valve 300 is opened to a maximum. This increases the back pressure Pm. Thus, in a case in which the check valve 350 closes the supply passage 145 (at the time of maximum discharge displacement), the check valve 350 opens the supply passage 145 and, at the same time, the second control valve 400 closes the first discharge passage 146*a*. The discharge passage 146 is thereby constituted only by the second discharge passage 146*b*, and the pressure in the crank chamber 140 increases and the inclination of the swash plate 111 decreases, maintaining the discharge displacement at a minimum.

Substantially simultaneously with this, the discharge check valve 200 blocks the discharge passage, and refrigerant discharged at the minimum discharge displacement does not flow to the external refrigerant circuit but circulates through an internal circulation passage formed by the discharge chamber 142, the supply passage 145, the crank chamber 140, the second discharge passage 146*b*, the suction chamber 141, and the cylinder bore 101*a*. In this state, refrigerant in the region of the supply passage 145 between the first control valve 300 and the check valve 350, that is, the refrigerant gas in the intermediate supply passage 145*b*1 slightly flows out into the suction chamber 141 through the back-pressure relief passage 147 provided so as to bypass the second control valve 400.

When in this state electricity is supplied to the molded coil 314 of the first control valve 300, the first control valve 300 is closed to close the supply passage 145, and the refrigerant in the intermediate supply passage 145*b*1 flows out into the suction chamber 141 through the back-pressure relief passage 147. Then, the pressure in the intermediate supply passage 145*b*1 (back pressure Pm) is reduced, and the check valve 350 closes the supply passage 145, preventing backflow of the refrigerant to the supply passage 145 upstream of the check valve 350. At the same time, the second control valve 400 opens the first discharge passage 146*a*. Thus, at this time, the discharge passage 146 is formed by both the first discharge passage 146*a* and the second discharge passage 146*b*.

The flow passage sectional area in the second control valve 400 is set to be greater than the flow passage sectional area of the groove 150*a*, which serves as the fixed throttle, and the refrigerant in the crank chamber 140 quickly flows out into the suction chamber 141 to reduce the pressure in the crank chamber 140, with the discharge displacement increasing from the minimum state to the maximum discharge displacement. As a result, the pressure in the discharge chamber 142 increases abruptly to open the discharge check valve 200, and the refrigerant circulates through the external refrigerant circuit to place the air conditioning system in the operating state.

When the air conditioning system operates, and the pressure in the suction chamber 141 decreases thereby and reaches the set pressure set due to the electric current flowing through the molded coil 314, the first control valve 300 is opened. This increases the back pressure Pm, whereby the check valve 350 opens the supply passage 145 and, at the same time, the second control valve 400 closes the first discharge passage 146*a*. Thus, at this time, the discharge passage 146 is constituted only by the second discharge passage 146*b*. As a result, the inflow of the refrigerant of the crank chamber 140 into the suction chamber 141 is restricted, and the pressure in the crank chamber 140 is easily increased. Then, the opening degree of the first control valve 300 is adjusted so that the pressure in the suction chamber 141 maintains the set pressure, and the discharge displacement is controlled to be variable.

According to the variable displacement compressor 100 of the present embodiment, the spool 440 of the second control valve 400 is supported in a manner slidable in opening and closing directions on the partition member 430 by arranging the spool valve 440*a*, constituted by the valve portion 442 and the shaft portion 443, to be in sliding contact with the partition member 430. That is, the spool 440 is supported in a manner slidable in opening and closing directions on the partition member 430, employing, as a sliding contact portion, a portion of the spool 440 (i.e., a portion of the spool valve 440*a*) other than the pressure receiving portion 441 disposed in the back pressure chamber 410, into which foreign matter might flow. Thus, the support portion of the spool 440 is set to a portion of the spool 440 that is other than the pressure receiving portion 441. Thus, even if foreign matter flows in together with refrigerant in the back pressure chamber 410 through the intermediate supply passage 145*b*1 when the first control valve 300 opens the supply passage 145, it is possible to satisfactorily operate the spool 440. In this manner, it is possible to provide the variable displacement compressor 100 capable of preventing or suppressing the occurrence of spool operation failure due to the inflow of foreign matter into the back pressure chamber 410.

Furthermore, since the back pressure chamber 410 provides an extension (expansion) space between the communication passage 104*k* and the passage constituted by the clearance between the outer peripheral surface of the shaft portion 443 and the hole wall surface of the through hole 432*a* of the partition member 430, it is possible to decrease the flow rate of refrigerant in the back pressure chamber 410 flowing into the back pressure chamber 410 from the communication passage 104*k*. Thus, even if foreign matter flows into the back pressure chamber 410 together with refrigerant from the communication passage 104*k*, it is possible to make the foreign matter stay in the back pressure chamber 410, and it is possible to prevent or suppress the foreign matter from flowing into the clearance between the outer peripheral surface of the shaft portion 443 and the hole wall surface of the through hole 432*a*.

In the present embodiment, the spool 440 has a circular cross-section, and is arranged so as to extend in one direction crossing the direction of gravity. The spool 440 is configured so that the lower part in the direction of gravity of the outer peripheral surface of the shaft portion 443 of the spool valve 440*a* is arranged to be in sliding contact with the lower part in the direction of gravity of the hole wall surface of the through hole 432*a* of the partition member 430. Accordingly, since the support portion of the spool 440 on the partition member 430 is provided at the shaft portion 443, which is the central portion in the one direction (spool longitudinal direction) and the radial direction of the spool 440, it is possible to satisfactorily operate the spool 440.

In the present embodiment, the spool 440 is arranged so that the spool center-of-gravity position G in one direction is located in the through hole 432*a* of the partition member 430. Thereby, the inclination of the spool 440 is prevented or suppressed, and the spool 440 can be stably supported by the through hole 432*a* of the partition member 430, so that it is possible to operate the spool 440 more satisfactorily.

In the present embodiment, the partition member 430 has: the end wall 432 in which the through hole 432*a* is formed; and the cylindrical peripheral wall 431 that extends from the end wall 432 toward the valve seat 103*f*, contacts the wall surface (valve plate 103) on which the valve seat 103*f* is formed, and is formed with the discharge hole 431*a*. This allows the peripheral wall 431 to position the end wall 432, and the end wall 432 to partition the back pressure chamber 410 and the valve chamber 420.

In the present embodiment, the variable displacement compressor 100 (second control valve 400) further provided with the biasing member 450 provided between the outer peripheral surface of the pressure receiving portion 441 and the inner wall surface of the back pressure chamber 410, the biasing member 450 urging the partition member 430 toward the valve seat 103*f*. This makes it possible to utilize an empty space between the outer peripheral surface of the pressure receiving portion 441 of the spool 440 and the inner wall surface of the back pressure chamber 410 by disposing the biasing member 450 to thereby position and hold the partition member 430. Since the arrangement space of the biasing member 450 can be easily obtained, a helical compression spring, which is relatively low in manufacturing cost and for which it is easy to control quality, can be employed as the biasing member 450.

In the present embodiment, as shown in FIG. 9, the valve chamber 420-side end of the through hole 432*a* formed in the partition member 430 is expanded in diameter on the back pressure chamber 410 side. Thereby, the end wall-side end surface 442*b* also functions as a pressure receiving surface Pm in a state in which the end wall-side end surface 442*b* of the valve portion 442 is in contact with the valve portion-side end surface 432*c* of the end wall 432. This allows the spool 440 to receive the back pressure Pm by the pressure receiving end surface 441*a* of the pressure receiving portion 441 and the end wall-side end surface 442*b* of the valve portion 442. Thus, it is possible to form the pressure receiving portion 441 to have a relatively smaller outer diameter.

In the present embodiment, the check valve 350 is provided in the downstream side supply passage 145*b* extending between the first control valve 300 and the crank chamber 140 in the supply passage 145, and the back pressure chamber 410 of the second control valve 400 communicates with the intermediate supply passage 145*b*1 extending between the first control valve 300 and the check valve 350 in the downstream side supply passage 145*b* through the communication passage 104*k*. Of this communication passage 104*k*, at least the communication passage-side connection portion 104*k*1 extending from the connection portion 104*e* toward the back pressure chamber 410 extends at an acute angle with respect to the communication passage 104*d*, serving as the intermediate supply passage side connection portion extending from the connection portion 104*e* toward the first control valve 300 in the intermediate supply passage 145*b*1. As a result, even when the first control valve 300 opens the supply passage 145, and foreign matter circulates through the intermediate supply passage 145*b*1 along with the refrigerant, all or the major portion of the foreign matter flows along the mainstream flow of the refrigerant flowing in the connection portion 104*e* from the first control valve 300 toward the check valve 350. As a result, it is possible to prevent or suppress the inflow of foreign matter into the back pressure chamber 410, and ultimately, it is possible to further increase the reliability of the operation of the spool 440.

In the present embodiment, the distance between the valve seat-side end surface 442*a* of the valve portion 442 and the partition member-side end surface 441*b* of the pressure receiving portion 441 is determined so that in a state in which the valve portion 442 contacts with the valve seat 103*f*, the pressure receiving portion 441 contacts the pressure receiving portion-side end surface 432*b* of the partition member 430, whereby the communication between the back pressure chamber 410 and the valve chamber 420 through the clearance between the through hole 432*a* formed in the partition member 430 formed for the insertion of the shaft portion 443 and the shaft portion 443. The back-pressure relief passage 147 is formed so as to bypass the second control valve 400 and to provide direct communication between the connection portion 104*e* of the intermediate supply passage 145*b*1 and the suction chamber 141. Thereby, when the first control valve 300 opens the supply passage 145, there is no or little steady flow of refrigerant into the back pressure chamber 410, and thus, it is possible to more reliably prevent or suppress the inflow of foreign matter into the back pressure chamber 410.

In the present embodiment, in a state in which the first control valve 300 closes the supply passage 145 and in which the valve seat-side end surface 442*a* of the valve portion 442 is spaced away from the valve seat 103*f* to a maximum, the end wall-side end surface 442*b* of the valve portion 442 contacts the end wall 432 (the valve portion-side end surface 432*c*), whereby the second control valve 400 cuts off the communication between the valve chamber 420 and the back pressure chamber 410 via the through hole 432*a*. Thus, even when the first control valve 300 closes the supply passage 145, and foreign matter flows through the discharge passage 146 together with refrigerant and then flows into the valve chamber 420, all or the major part of the foreign matter flows to the suction chamber 141 together with the refrigerant through the opened discharge passage 146. Thus, it is possible to prevent or suppress foreign matter from entering the clearance between the outer peripheral surface of the shaft portion 443 and the hole wall surface of the through hole 432*a* of the partition member 430. Therefore, even if there is a concern that foreign matter may flow into the valve chamber 420 through the discharge passage 146, it is possible to operate the spool 440 satisfactorily.

Modification of First Embodiment

In the present embodiment, the spool center-of-gravity position G is located in the through hole 432*a* of the partition member 430, but is not necessarily limited thereto.

Although the biasing member 450 is constituted by the helical compression spring in the present embodiment, the present invention is not limited thereto. A member with an appropriate form may be employed by effectively using the empty space between the outer peripheral surface of the pressure receiving portion 441 of the spool 440 and the inner wall surface of the back pressure chamber 410.

Figure 10:
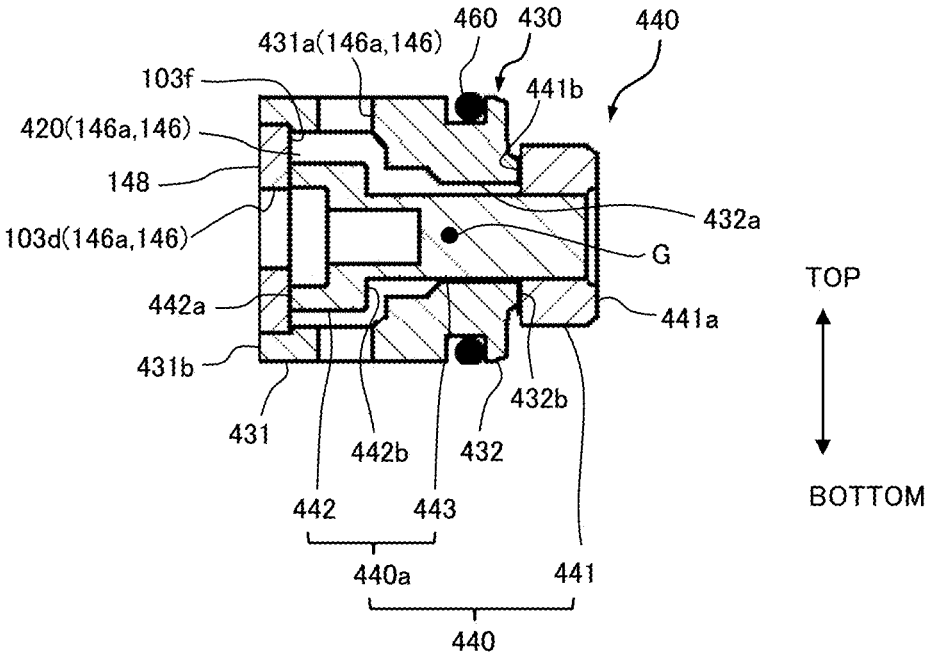
FIG. 10 is a cross-sectional view illustrating a modified example of the second control valve.

Although, in the present embodiment, the open end of the partition member 430 is closed by the valve plate 103, and the valve plate 103 is used as the valve seat forming member of the second control valve 400, the present invention is not limited thereto. As the valve seat forming member of the second control valve 400, a member interposed between the cylinder block 101 and the cylinder head 104, such as the suction valve forming plate 150 or the discharge valve forming plate 151, may be used. As shown in FIG. 10, the second control valve 400 may be integrally provided with a dedicated valve seat forming member 148. Specifically, as shown in FIG. 10, the valve seat forming member 148 is fixed by press-fitting into, for example, the end surface 431*b*-side opening of the peripheral wall 431. In this case, it is desirable that the end surface 431*b* of the peripheral wall 431 or the end surface of the valve seat forming member 148 be brought into contact with the rubber-coated head gasket 153. When one of the suction valve forming plate 150, the discharge valve forming plate 151, and the valve plate 103 is used as the valve seat forming member, there is no need to add a dedicated valve seat forming member. Furthermore, this provides a satisfactory flatness, which is suitable for the valve seat forming member.

Although, in the present embodiment, the peripheral wall 431 of the partition member 430 is slidably supported by the peripheral wall of the second accommodation chamber 104*g*2, the present invention is not limited thereto. It may be forced into and fit-engaged with the second accommodation chamber 104*g*2 and set in position in the cylinder head 104. In this case, there is no need to provide the O-ring 460 or the biasing member 450. In the present embodiment, the partition member 430 includes the end wall 432 and the peripheral wall 431, and has a configuration such that the end wall 432 partitions into the back pressure chamber 410 and the valve chamber 420, and the cylindrical peripheral wall 431 stably positions the end wall 432 with respect to the valve plate 103. However, the present invention is not limited thereto. It is sufficient for the partition member 430 to have the end wall 432 in which the through hole 432*a* is formed and that partitions into the back pressure chamber 410 and the valve chamber 420, and to have a member capable of positioning the end wall 432 with respect to the valve plate 103. For example, the partition member 430 may have multiple (for example, three) rods that extend from the end wall 432 toward the valve seat 103*f* and contact the valve plate 103, instead of the cylindrical peripheral wall 431. In this case, each clearance formed between rods adjacent to each other corresponds to the discharge hole 431*a*.

Although, in the present embodiment, the discharge passage 146 branches into the first discharge passage 146*a* and the second discharge passage 146*b* at the space 101*d*, and the first discharge passage 146*a* is opened and closed by the second control valve 400, and the second discharge passage 146*b* is constantly kept open to thereby secure the minimum opening degree of the discharge passage 146 when the second control valve 400 is closed, the present invention is not limited thereto. For example, instead of the second discharge passage 146*b*, a through hole may be formed in the peripheral wall of the valve portion 442, or a groove may be provided in the valve seat-side end surface 442*a* of the valve portion 442, thereby securing the minimum opening degree of the discharge passage 146. Furthermore, the discharge passage 146 may be configured so that passages extending from the crank chamber 140 to the suction chamber 141 are provided in parallel, and one passage is opened and closed by the second control valve 400.

Second Embodiment

Figure 11A:
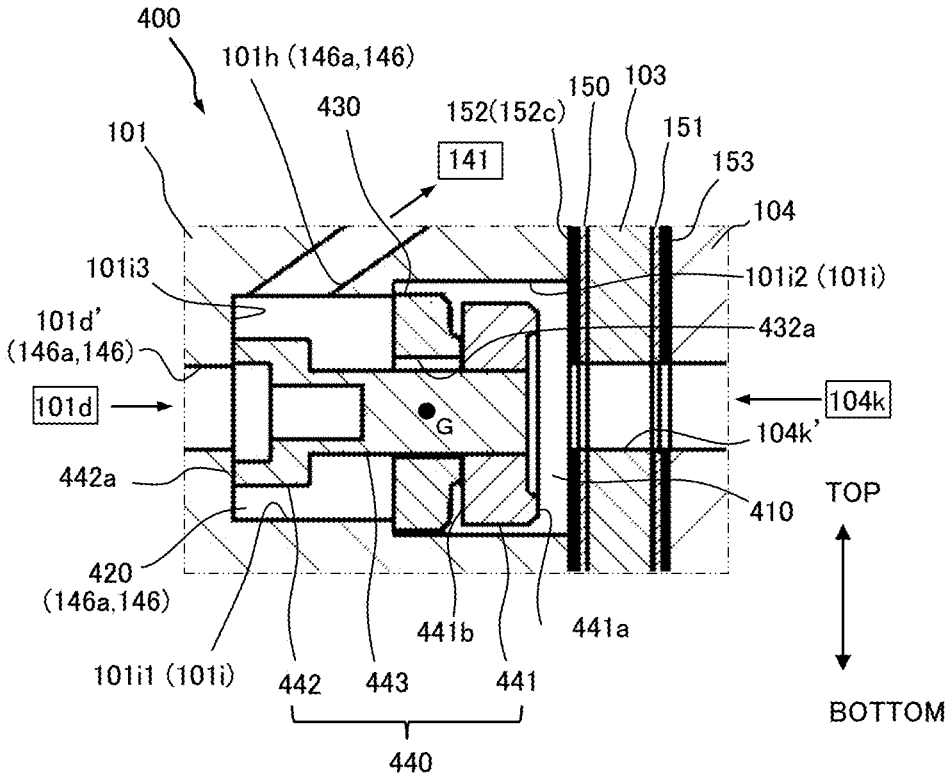
FIGS. 11A and 11B are enlarged cross-sectional views of the main part of a variable displacement compressor according to a second embodiment of the present invention.
Figure 11B:
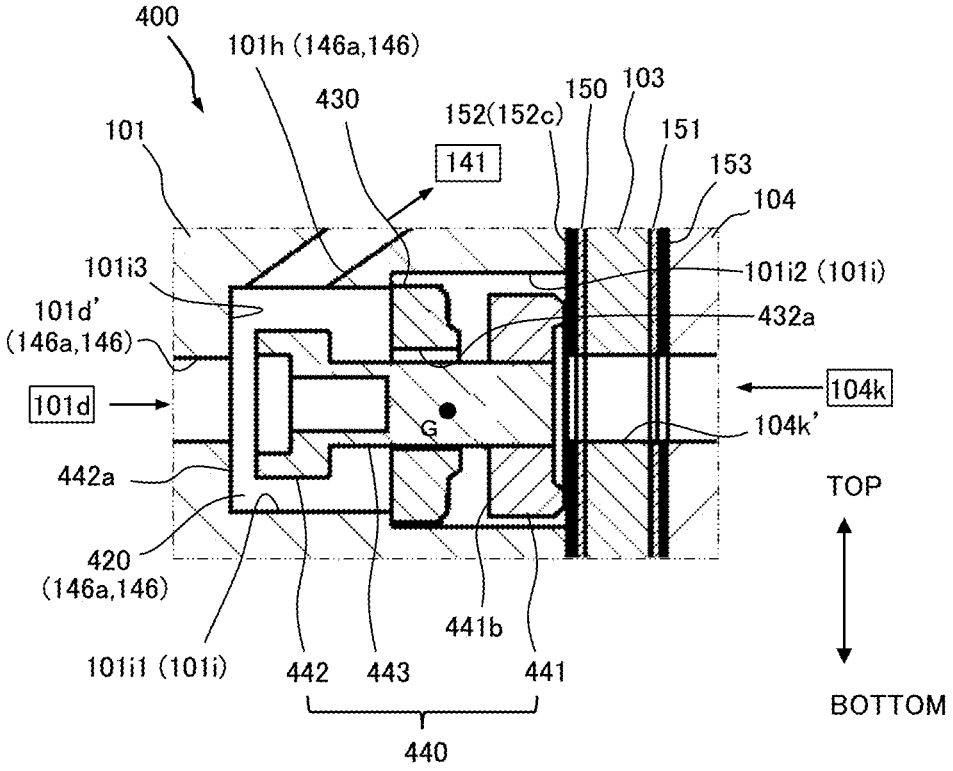

FIGS. 11A and 11B are enlarged cross-sectional views of the main part of the variable displacement compressor according to the second embodiment of the present invention. FIG. 11A shows a state in which the second control valve 400 closes the first discharge passage 146*a*. FIG. 11B shows a state in which the second control valve 400 opens the first discharge passage 146*a*. The same elements as in the first embodiment are denoted by the same reference numerals, and their descriptions will therefore be omitted. Only differences will be described.

In the variable displacement compressor 100 of the second embodiment, the installation position of the second control valve 400 and the shape of the partition member 430 are different from those of the first embodiment. The second control valve 400 is disposed in the cylinder block 101. The partition member 430 is formed in a ring shape.

Specifically, the second control valve 400 is accommodated in an accommodating hole 101*i* formed at the end of the cylinder block 101 on the valve plate 103 side.

More specifically, the accommodating hole 101*i* is constituted by a small diameter portion 101*i*1 on the crank chamber 140 side and a large diameter portion 101*i*2 on the valve plate 103 side having a diameter greater than the small diameter portion 101*i*1. The valve portion 442 is disposed in the small diameter portion 101*i*1, and the pressure receiving portion 441 is disposed in the large diameter portion 101*i*2. The partition member 430 is formed in a disk shape. The partition member 430 is arranged so that a radial outer edge portion of the end surface of the partition member 430 contacts a step portion formed between the large diameter portion 101*i*2 and the small diameter portion 101*i*1, so as to partition into a region of the large diameter portion 101*i*2 and a region of the small diameter portion 101*i*1.

A valve hole 101*d*' communicating with the space 101*d* is open on the bottom wall of the small diameter portion 101*i*1. The valve hole 101*d*' constitutes the second control valve-side end of the upstream discharge passage 146*c* extending between the second control valve 400 and the crank chamber 140 in the discharge passage 146, and corresponds to the valve hole 103*d* of the first embodiment. A valve seat 101*i*3 is formed around the valve hole 101*d*' in the bottom wall of the small diameter portion 101*i*1. The valve portion 442 contacts and departs from the valve seat 101*i*3. A discharge hole 101*h* communicating with the suction chamber 141 is open on the inner wall surface of the small diameter portion 101*i*1. The discharge hole 101*h* corresponds to the discharge hole 431*a* of the first embodiment. Thus, the small diameter portion 101*i*1 constitutes the valve chamber 420.

To the valve plate 103-side opening end of the large diameter portion 101*i*2, there is open a communication passage 104*k*' that extends to extend the communication passage 104*k* in the cylinder head 104 and extends through the interposed objects (153, 151, 103, 150, 152) disposed between the cylinder block 101 and the cylinder head 104. The large diameter portion 101*i*2 communicates with the intermediate supply passage 145*b*1 through the communication passage 104*k* and the communication passage 104*k*'. Thus, the large diameter portion 101*i*2 constitutes the back pressure chamber 410.

Although not shown in FIGS. 11A and 11B, the biasing member (450) that urges the partition member 430 toward the valve seat 101*i*3 is disposed. In the second embodiment, as shown in FIG. 11B, in a state in which the first control valve 300 closes the supply passage 145 and in which the valve portion 442 of the second control valve 400 is spaced away from the valve seat 101*i*3 to a maximum, the pressure receiving portion 441 contacts the cylinder gasket 152 to close the opening of the communication passage 104*k*'. The member with which the pressure receiving portion 441 comes into contact is not limited to the cylinder gasket 152, but may be the suction valve forming plate 150 or the valve plate 103.

According to the variable displacement compressor 100 of the second embodiment, the spool 440 of the second control valve 400 is also supported in a manner slidable in opening and closing directions on the partition member 430 by arranging the spool valve 440*a*, constituted by the valve portion 442 and the shaft portion 443, to be in sliding contact with the partition member 430. Therefore, similarly to the first embodiment, it is possible to provide the variable displacement compressor 100 capable of preventing or suppressing the occurrence of spool operation failure due to the inflow of foreign matter into the back pressure chamber 410. In the second embodiment, the same modified example as in the first embodiment can be applied.

Although in the present embodiments the variable displacement compressor 100 is formed as a swash plate type clutchless variable displacement compressor, the present invention is not limited thereto. The variable displacement compressor 100 may be formed as a variable displacement compressor to which an electromagnetic clutch is attached, or as a variable displacement compressor driven by a motor.

The contents of the invention have been described in detail above with reference to the preferred embodiments, but it is apparent that one skilled in the art can make various types of modifications based on the basic technical concept and teachings of the invention.

Reference Example

Finally, a variable displacement compressor according to a Reference Example of the variable displacement compressor of the present invention will be described.

Figure 12:
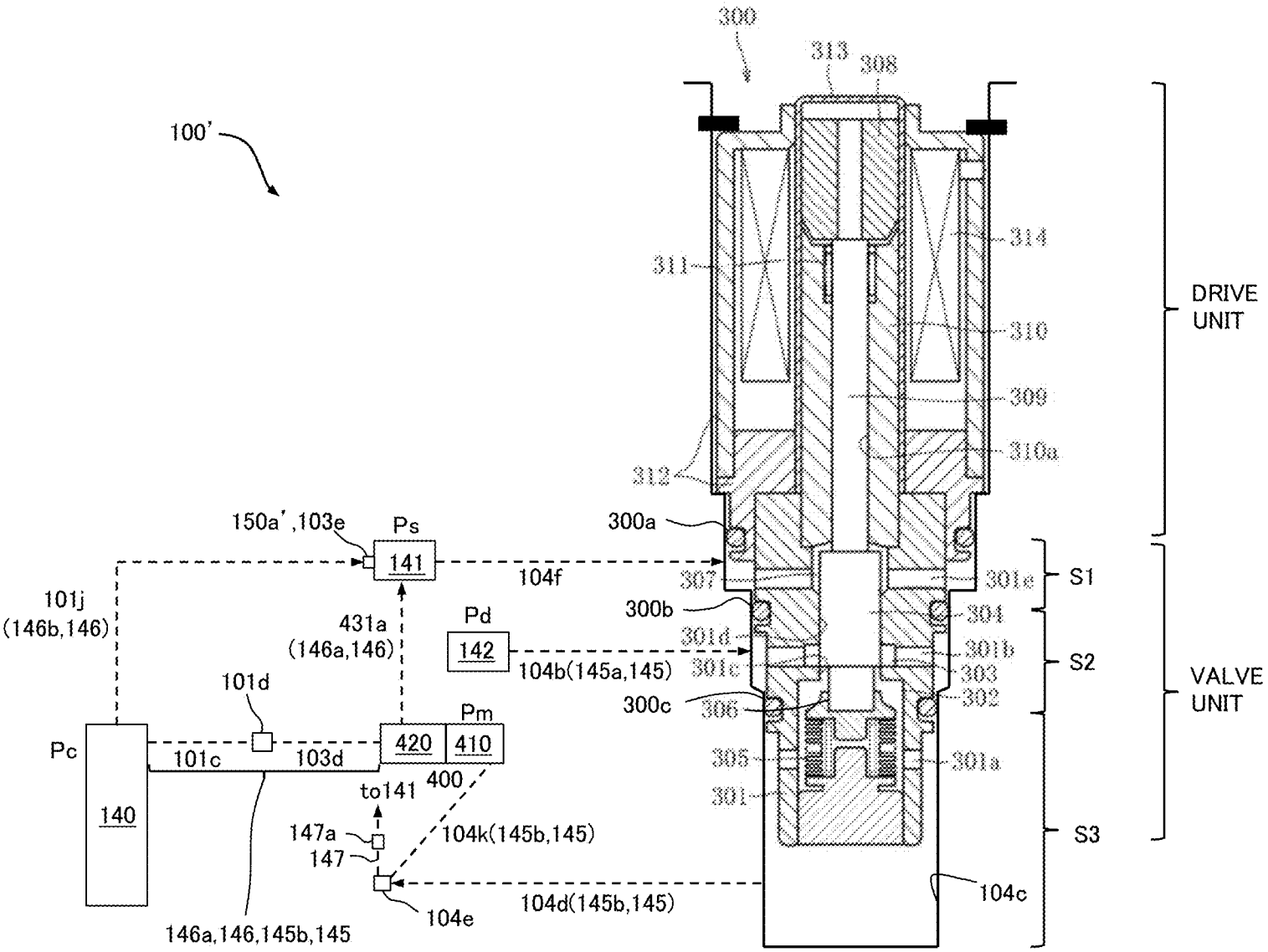
FIG. 12 is a cross-sectional view of a first control valve of a variable displacement compressor according to a Reference Example of the present invention, and a conceptual diagram illustrating a system diagram of passages through which refrigerant flows.
Figure 13:
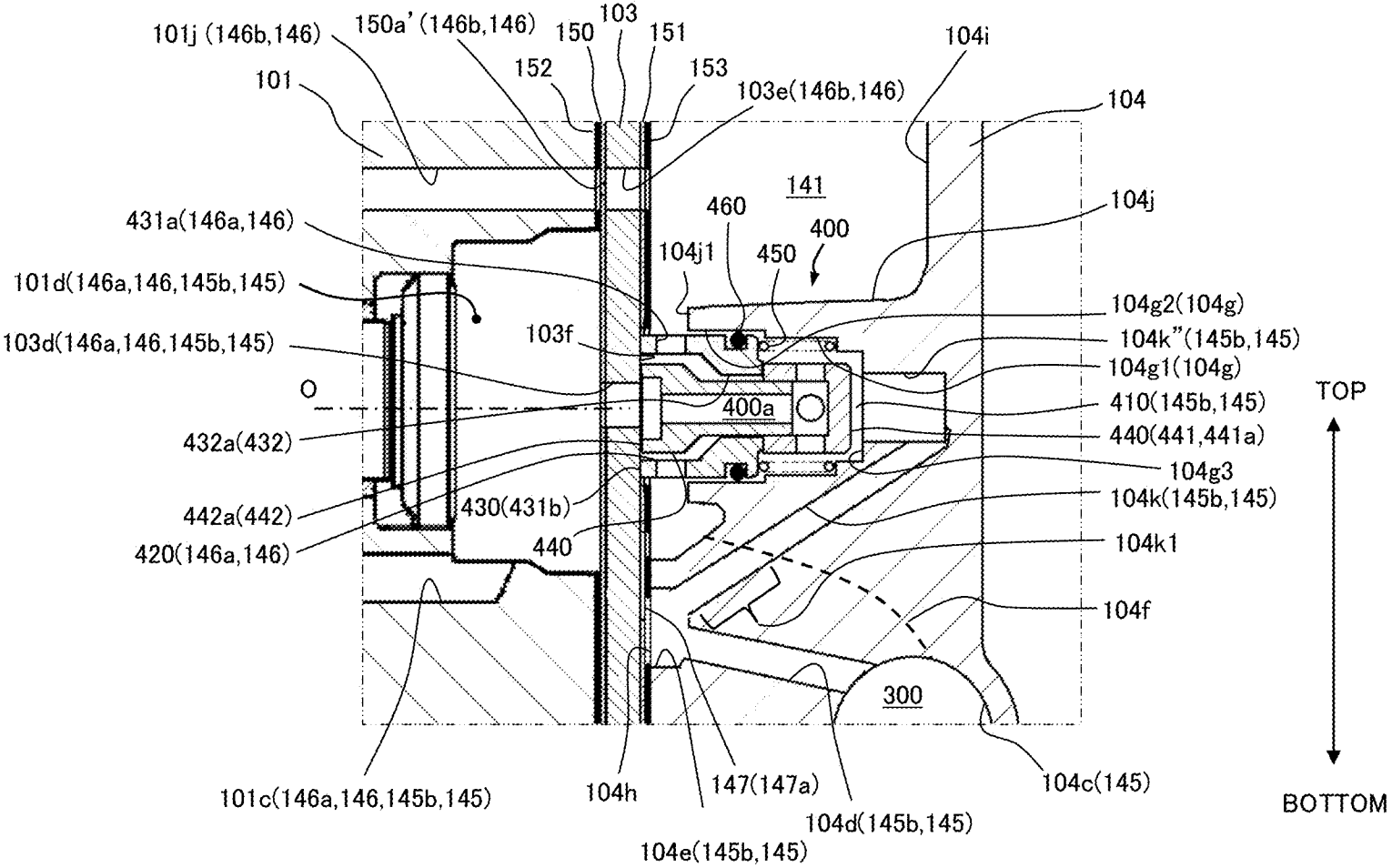
FIG. 13 is an enlarged cross-sectional view illustrating the main part of the variable displacement compressor according to the Reference Example.
Figure 14A:
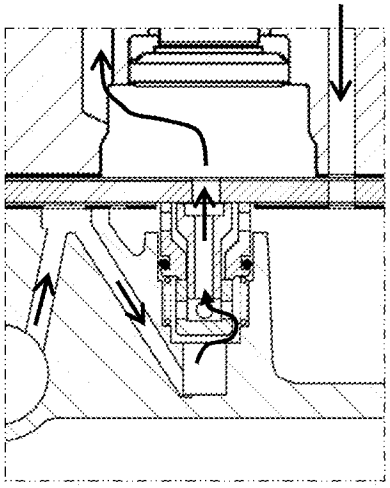
FIGS. 14A, 14B, and 14C are conceptual views for explaining flow of refrigerant in each operation state of the variable displacement compressor according to the Reference Example.
Figure 14B:
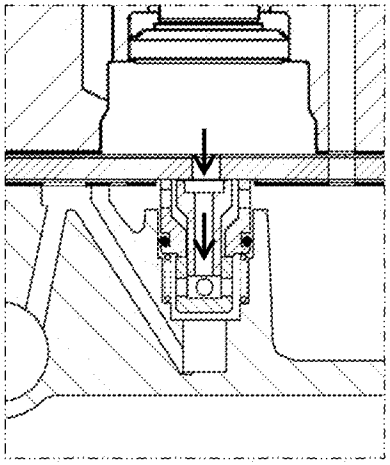
Figure 14C:
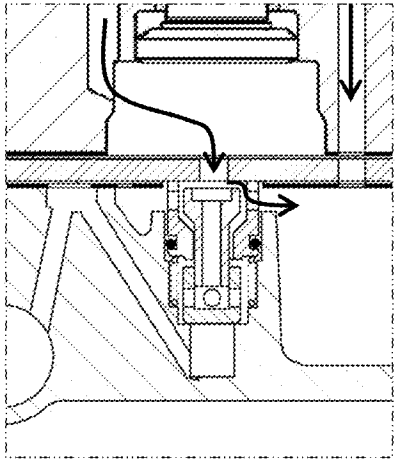

FIG. 12 is a cross-sectional view of the first control valve 300 of a variable displacement compressor 100' according to the Reference Example, and a conceptual diagram illustrating a system diagram of passages through which refrigerant flows. FIG. 13 is an enlarged cross-sectional view illustrating the main part of the variable displacement compressor 100', and FIGS. 14A, 14B and 14C are conceptual views for explaining flow of refrigerant in each operation state of the variable displacement compressor 100'. The same elements as those of the variable displacement compressor 100 according to the first embodiment of the present invention are denoted by the same reference numerals, and their descriptions will therefore be omitted. Only differences will be described.

The variable displacement compressor 100' according to the present Reference Example differs from the configuration of the variable displacement compressor 100 according to the first embodiment in the following features: (1) the first discharge passage 146*a* and the second discharge passage 146*b* extend in parallel to form the discharge passage 146; (2) a part of the downstream side supply passage 145*b* of the supply passage 145 also serves as a part of the discharge passage 146; and (3) the second control valve 400 also serves as the check valve 350. In the following, items relating to (1) to (3) will be mainly described.

Exhaust Passage of Reference Example

As shown in FIGS. 12 and 13, in the variable displacement compressor 100' according to the Reference Example, the first discharge passage 146*a* that is controlled to be opened and closed by the second control valve 400, and the second discharge passage 146*b* that provides continuous communication between the crank chamber 140 and the suction chamber 141 extend in parallel. That is, the first discharge passage 146*a* and the second discharge passage 146*b* individually extend between the crank chamber 140 and the suction chamber 141. The discharge passage 146 for discharging refrigerant in the crank chamber 140 to the suction chamber 141 is constituted by the first discharge passage 146*a* and the second discharge passage 146*b* provided in parallel. The second control valve 400 is provided in the middle of the first discharge passage 146*a*, and adjusts (controls) the opening degree of the first discharge passage 146*a* to adjust the opening degree of the discharge passage 146.

Specifically, the first discharge passage 146*a* is formed so as to be open to the suction chamber 141 through the communication passage 101*c* passing through the front housing 102-side end surface of the cylinder block 101 and extending toward the cylinder head 104, the space 101*d*, the communication hole of the cylinder gasket 152, the communication hole of the suction valve forming plate 150, the valve hole 103*d*, the valve chamber 420, and the discharge hole 431*a*. Specifically, the first discharge passage 146*a* according to the Reference Example differs from that according to the first embodiment in that the communication passage 101*c* of the Reference Example extends below the drive shaft 110, whereas the communication passage 101*c* of the first embodiment extends above the drive shaft 110.

Specifically, the second discharge passage 146*b* is formed to bypass the second control valve 400 by extending through the communication passage 101*j* passing through the cylinder block 101 and extending above the drive shaft 110 in the extending direction of the axis O, the communication hole of the cylinder gasket 152, an orifice 150*a'*, serving as a fixed throttle, formed in the suction valve forming plate 150, the communication hole 103*e* of the valve plate 103, the communication hole of the discharge valve forming plate 151, and the communication hole of the head gasket 153, and provides continuous communication between the crank chamber 140 and the suction chamber 141. The flow passage sectional area of the first discharge passage 146*a* when opened by the second control valve 400 is determined to be greater than the flow passage sectional area of the orifice 150*a'*, serving as the fixed throttle, of the second discharge passage 146*b*. Specifically, the second discharge passage 146*b* according to the Reference Example differs from that according to the first embodiment in that the communication passage 101*j* is additionally provided in the cylinder block 101, and in that the fixed throttle, corresponding to the fixed throttle (groove 150*a*) formed in the suction valve forming plate 150 of the first embodiment, is not a groove, but the orifice 150*a'*.

Supply Passage of Reference Example

The supply passage 145 is connected to the crank chamber 140 through the second control valve 400. A part of the downstream side supply passage 145*b* of the supply passage 145 also serves as a part of the discharge passage 146. The upstream side supply passage 145*a* according to the Reference Example is the same as that according to the first embodiment. The configuration from the first control valve 300 to the connection portion 104*e* in the downstream side supply passage 145*b* according to the Reference Example is also the same as that according to the first embodiment.

Specifically, the downstream side supply passage 145*b* is formed so as to be open to the crank chamber 140 through the communication passage 104*d* of the cylinder head 104, the connection portion 104*e* of the cylinder head 104, the inclined communication passage 104*k* of the cylinder head 104, a valve hole 104*k*" that is open at the center of the bottom wall 104*g*3 of the first accommodation chamber 104*g*1 and connects the first accommodation chamber 104*g*1 and the communication passage 104*k*, the first accommodation chamber 104*g*1 (back pressure chamber 410), an internal passage 400*a*, the valve hole 103*d*, the communication hole of the suction valve forming plate 150, the communication hole of the cylinder gasket 152, the space 101*d* of the cylinder block 101, and the communication passage 101*c* of the cylinder block 101. Therefore, the passage section in the downstream side supply passage 145*b* constituted by the valve hole 103*d*, the communication hole of the suction valve forming plate 150, the communication hole of the cylinder gasket 152, the space 101*d*, and the communication passage 101*c* also serves as a part of the first discharge passage 146*a*.

Second Control Valve of Reference Example

As shown in FIGS. 12, 13, and 14A, 14B and 14C, the variable displacement compressor 100' according to the Reference Example does not include the check valve 350 that is provided separately from the first control valve 300, the second control valve 400, and the like. In the Reference Example, the second control valve 400 is configured to also function as the check valve 350.

The second control valve 400 has the internal passage 400*a* that extends through the spool 440 from the pressure receiving portion 441 to the valve portion 442. In the Reference Example, in a state in which the first control valve 300 closes the supply passage 145 and in which the valve seat-side end surface 442*a* of the valve portion 442 is spaced away from the valve seat 103*f* to a maximum, the pressure receiving end surface 441*a* (see FIG. 13) of the pressure receiving portion 441 is configured to contact the bottom wall 104*g*3 of the first accommodation chamber 104*g*1 to close the valve hole 104*k*", as shown in FIG. 14C. Thus, the second control valve 400 closes the downstream side supply passage 145*b* when the first control valve 300 closes the supply passage 145 and the pressure receiving portion 441 contacts the bottom wall 104*g*3. This allows the second control valve 400 to operate to prevent the backflow of refrigerant flowing from the crank chamber 140 toward the first control valve 300, and to allow refrigerant to flow from the first control valve 300 toward the crank chamber 140. In this manner, the second control valve 400 according to the Reference Example also serves as the check valve 350 as in the first embodiment.

Specifically, the internal passage 400*a* has one end portion that is formed to open at multiple portions spaced apart in the circumferential direction on the outer circumferential surface of the pressure receiving portion 441, and the other end portion that is open at the valve seat-side end surface 442*a* of the valve portion 442. The structure of the second control valve 400 of the Reference Example is the same as the second control valve 400 of the first embodiment, except that the second control valve 400 of the Reference Example includes the internal passage 400*a* and the pressure receiving portion 441 contacts the bottom wall 104*g*3.

Hereinafter, the following components in the Reference Example are referred to as follows for convenience: the pressure receiving portion 441 is referred to as "first valve portion 441", the valve hole 104*k*" is referred to as "first valve hole 104*k*'", the bottom wall 104*g*3 is referred to as "first valve seat 104*g*3", the valve portion 442 is referred to as "second valve portion 442", the valve hole 103*d* is referred to as "second valve hole 103*d*", and the valve seat 103*f* is referred to as "second valve seat 103*f*".

In other words, the second control valve 400 is a switch valve configured to switch between a first state (state shown in FIG. 14A) and a second state (the state shown in FIG. 14C), described in detail below, by being arranged in the downstream side supply passage 145*b* configured as described above. Specifically, the second control valve 400 is a switch valve provided in the downstream side supply passage 145*b*, and is configured to switch between the first state and the second state. The first state provides communication between the first valve hole 104*k*" constituting the back pressure chamber 410-side opening end of the first downstream side supply passage extending between the first control valve 300 and the second control valve 400 in the downstream side supply passage 145*b*, and the second valve hole 103*d* constituting the second control valve-side end of the second downstream side supply passage extending between the second control valve 400 and the crank chamber 140 in the downstream side supply passage 145*b*. The second state provides communication between the second valve hole 103*d* and the discharge hole 431*a* communicating with the suction chamber 141.

Specifically, as shown in FIG. 14A, when the first control valve 300 opens the supply passage 145 and the pressure (back pressure Pm) in the first downstream side supply passage is greater than the pressure Pc of the crank chamber 140, the spool 440 of the second control valve 400 moves away from the first valve seat 104*g*3 and contacts the second valve seat 103*f*, to provide communication between the first valve hole 104*k*" and the second valve hole 103*d* through the internal passage 400*a*, and to cut off communication between the second valve hole 103*d* and the discharge hole 431*a*. This switches the state of the second control valve 400 to the first state, as shown in FIG. 14A, and in this state, refrigerant is supplied to the crank chamber 140 through the downstream side supply passage 145*b* including the internal passage 400*a*, as indicated by solid arrows.

Then, as shown in FIG. 14B, immediately after the first control valve 300 closes the supply passage 145, the back pressure Pm begins to drop from the pressure Pc of the crank chamber 140, and the spool 440 begins to move toward the first valve seat 104*g*3. In this state, as indicated by solid arrows, refrigerant flows through the internal passage 400*a* toward the first valve portion 441, and presses the spool 440 toward the first valve seat 104*g*3.

Then, as shown in FIG. 14C, the spool 440 contacts the first valve seat 104*g*3 and moves away from the second valve seat 103*f*, to cut off communication between the first valve hole 104*k*" and the second valve 103*d*, and to provide communication between the second valve hole 103*d* and the discharge hole 431*a*. This switches the state of the second control valve 400 to the second state, as shown in FIG. 14C, and in this state, refrigerant in the crank chamber 140 is discharged to the suction chamber 141 through the first discharge passage 146*a* and the second discharge passage 146*b*, as indicated by solid arrows. Then, when the first control valve 300 opens the supply passage 145 in this second state, the state of the second control valve 400 switches to the first state, as shown in FIG. 14A.

Also in the variable displacement compressor 100' according to the Reference Example, the spool 440 of the second control valve 400 is supported in a manner slidable in opening and closing directions on the partition member 430 by arranging the spool valve 440*a* to be in sliding contact with the partition member 430. Therefore, similarly to the first embodiment, it is possible to provide the variable displacement compressor 100' capable of preventing or suppressing the occurrence of spool operation failure due to the inflow of foreign matter into the back pressure chamber 410. Furthermore, in the variable displacement compressor 100', since the second control valve 400 is configured to also function as the check valve 350, it is possible to reduce cost comparing with a case in which the check valve 350 is provided separately. Also in the Reference Example, modifications similar to that of the first embodiment can be applied. Furthermore, as in the second embodiment, the second control valve 400 may be provided in the cylinder block 101.

REFERENCE SYMBOL LIST

100 Variable displacement compressor
101*a* Cylinder bore (compression section)
101*d*' Valve hole (valve hole according to the second embodiment)
101*h* Discharge hole (discharge hole according to the second embodiment)
101*i*3 Valve seat (valve seat according to the second embodiment)
103*d* Valve hole (valve hole according to the first embodiment)
103*f* Valve seat (valve seat according to the first embodiment)
136 Piston (compression section)
140 Crank chamber (controlled pressure chamber)
141 Suction chamber
142 Discharge chamber
145 Supply Passage
145*b* Downstream side supply passage
145*b*1 Intermediate supply passage

146 Discharge Passage
146*c* Upstream side discharge passage
147 Back-pressure relief passage (throttle passage)
147*a* Throttle part
300 First control valve
350 Check Valve
400 Second control valve
410 Back pressure chamber
420 Valve chamber
430 Partition member
431 Peripheral wall
431*a* Discharge hole (discharge hole according to the first embodiment)
432 End wall
432*a* Through hole
440 Spool
440*a* Spool valve
441 Pressure receiving portion
442 Valve portion
443 Shaft portion
450 Biasing member
G Spool center-of-gravity position

The invention claimed is:

1. A variable displacement compressor including a suction chamber to which refrigerant is directed, a compression section configured to draw in the refrigerant in the suction chamber and compress the refrigerant, a discharge chamber into which the refrigerant compressed by the compression section is discharged, and a controlled pressure chamber, the variable displacement compressor changing discharge displacement depending on a pressure in the controlled pressure chamber, the variable displacement compressor comprising:

a first control valve provided in a supply passage for supplying the refrigerant in the discharge chamber to the controlled pressure chamber, the first control valve controlling an opening degree of the supply passage;

a check valve provided in a downstream side supply passage extending between the first control valve and the controlled pressure chamber in the supply passage, the check valve preventing backflow of the refrigerant flowing from the controlled pressure chamber toward the first control valve;

a second control valve provided in a discharge passage for discharging the refrigerant in the controlled pressure chamber into the suction chamber, the second control valve controlling an opening degree of the discharge passage; and a throttle passage providing communication between an intermediate supply passage extending between the first control valve and the check valve in the downstream side supply passage, and the suction chamber, the throttle passage having a throttle part, wherein the second control valve comprises:

a back pressure chamber communicating with the intermediate supply passage;

a valve chamber to which a valve hole and a discharge hole are open, the valve hole constituting a second control valve-side end of an upstream side discharge passage extending between the second control valve and the controlled pressure chamber in the discharge passage, the discharge hole communicating with the suction chamber, the valve chamber constituting a part of the discharge passage;

a partition member partitioning into the back pressure chamber and the valve chamber; and a spool comprising a pressure receiving portion disposed in the back pressure chamber, a valve portion disposed in the valve chamber and contacting and departing from a valve seat provided around the valve hole, and a shaft portion extending through a through hole formed in the partition member and connecting the pressure receiving portion and the valve portion;

wherein the second control valve is configured to move the spool depending on a pressure in the back pressure chamber and a pressure in the upstream side discharge passage so as to have the valve portion contact and depart from the valve seat, thereby controlling the opening degree of the discharge passage, wherein the spool is supported in a manner slidable in opening and closing directions on the partition member by arranging a spool valve, which is constituted by the valve portion and the shaft portion, to be in sliding contact with the partition member.

2. The variable displacement compressor according to claim 1, wherein the spool has a circular cross-section, and is arranged so as to extend in one direction crossing a direction of gravity, wherein the spool is configured so that a lower part in the direction of gravity of an outer peripheral surface of the shaft portion of the spool valve is arranged to be in sliding contact with a lower part in the direction of gravity of a hole wall surface of the through hole of the partition member.

3. The variable displacement compressor according to claim 2, wherein the spool is arranged so that a center of gravity of the spool in the one direction is located in the through hole of the partition member.

4. The variable displacement compressor according to claim 1, wherein the partition member has an end wall in which the through hole is formed, and a peripheral wall that extends from the end wall toward the valve seat and contacts a wall surface on which the valve seat is formed, and in which the discharge hole is formed.

5. The variable displacement compressor according to claim 1, further comprising a biasing member for urging the partition member toward the valve seat, the biasing member being disposed between an outer peripheral surface of the pressure receiving portion and an inner wall surface of the back pressure chamber.

6. The variable displacement compressor according to claim 5, wherein the biasing member comprises a helical compression spring.

7. The variable displacement compressor according to claim 2, wherein the partition member has an end wall in which the through hole is formed, and a peripheral wall that extends from the end wall toward the valve seat and contacts a wall surface on which the valve seat is formed, and in which the discharge hole is formed.

8. The variable displacement compressor according to claim 3, wherein the partition member has an end wall in which the through hole is formed, and a peripheral wall that extends from the end wall toward the valve seat and contacts a wall surface on which the valve seat is formed, and in which the discharge hole is formed.

9. The variable displacement compressor according to claim 2, further comprising a biasing member for urging the partition member toward the valve seat, the biasing member being disposed between an outer peripheral surface of the pressure receiving portion and an inner wall surface of the back pressure chamber.

10. The variable displacement compressor according to claim 3, further comprising a biasing member for urging the partition member toward the valve seat, the biasing member being disposed between an outer peripheral surface of the pressure receiving portion and an inner wall surface of the back pressure chamber.

11. The variable displacement compressor according to claim 4, further comprising a biasing member for urging the partition member toward the valve seat, the biasing member being disposed between an outer peripheral surface of the pressure receiving portion and an inner wall surface of the back pressure chamber.

* * * * *